US010427436B2

(12) United States Patent
Kanai

(10) Patent No.: US 10,427,436 B2
(45) Date of Patent: Oct. 1, 2019

(54) TEST PATTERN CREATION METHOD, TEST PATTERN, PRINTING SYSTEM, AND PROGRAM

(71) Applicant: SEIKO EPSON CORPORATION, Tokyo (JP)

(72) Inventor: Masashi Kanai, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/899,739

(22) Filed: Feb. 20, 2018

(65) Prior Publication Data

US 2018/0236798 A1 Aug. 23, 2018

(30) Foreign Application Priority Data

Feb. 21, 2017 (JP) ..... 2017-029918

(51) Int. Cl.

| | |
|---|---|
| ***B41J 29/393*** | (2006.01) |
| ***B41J 2/145*** | (2006.01) |
| ***B41J 2/21*** | (2006.01) |
| ***B41J 19/14*** | (2006.01) |

(52) U.S. Cl.

CPC ..... *B41J 29/393* (2013.01); *B41J 2/145* (2013.01); *B41J 2/2114* (2013.01); *B41J 2/2135* (2013.01); *B41J 19/145* (2013.01); *B41J 2029/3935* (2013.01)

(58) Field of Classification Search

CPC ..... B41J 29/393; B41J 2029/3935; B41J 2/2114; B41J 19/145; B41J 2/04505; B41F 33/0081; G03G 2215/0161; B41P 2233/52

See application file for complete search history.

(56) References Cited

U.S. PATENT DOCUMENTS

| | | | |
|---|---|---|---|
| 5,898,443 | A | 4/1999 | Yoshino et al. |
| 6,164,749 | A | 12/2000 | Williams |
| 6,371,609 | B1 | 4/2002 | Oikawa |
| 8,845,068 | B2 | 9/2014 | Kammerzell |
| 2007/0008370 | A1 | 1/2007 | Kawatoko et al. |
| 2007/0296752 | A1 | 12/2007 | Maruo et al. |

(Continued)

FOREIGN PATENT DOCUMENTS

| | | | |
|---|---|---|---|
| JP | 2005-022217 | A | 1/2005 |
| JP | 2005-022218 | A | 1/2005 |

(Continued)

OTHER PUBLICATIONS

Extended European Search Report dated Jul. 20, 2018 in related European Appl. 18157934.3 (8 pgs.).

*Primary Examiner* — Huan H Tran
(74) *Attorney, Agent, or Firm* — Foley & Lardner LLP

(57) ABSTRACT

A method of creating a test pattern includes: providing a printing apparatus including: a transparent ink print head configured to eject a transparent ink, a first print head configured to eject a first colored ink, and a second print head configured to eject a second colored ink; forming a base-coat on a print medium using the first colored ink; and creating a plurality of ruled lines to measure impact displacement of the transparent ink so as to form a first ruled line set formed by layering the transparent ink over the base-coat, and a second ruled line set formed outside a region corresponding to the base-coat using the second colored ink.

13 Claims, 22 Drawing Sheets

(56) References Cited

U.S. PATENT DOCUMENTS

| | | | | |
|---|---|---|---|---|
| 2011/0063634 | A1* | 3/2011 | Boness | B41F 33/0081 358/1.9 |
| 2011/0063643 | A1* | 3/2011 | Boness | G03G 15/0194 358/1.9 |
| 2014/0139583 | A1 | 5/2014 | Kammerzell | |

FOREIGN PATENT DOCUMENTS

| | | | |
|---|---|---|---|
| JP | 2007-015269 | A | 1/2007 |
| JP | 2008-001053 | A | 1/2008 |
| JP | 2012-035446 | A | 2/2012 |

* cited by examiner

TEST PATTERN CREATION METHOD, TEST PATTERN, PRINTING SYSTEM, AND PROGRAM

CROSS-REFERENCE TO RELATED APPLICATIONS

The present application claims priority to Japanese Patent Application No. 2017-029918, filed on Feb. 21, 2017, the contents of which are hereby incorporated by reference in their entirety.

BACKGROUND

1. Technical Field

The present disclosure relates to a printing test pattern.

2. Related Art

JP-A-2007-015269 describes detecting tilt of a recording head and misalignment arising between an forward pass and a reverse pass of the recording head. Here, "tilt" is positional misalignment arising due to rotation about a direction orthogonal to a primary scan direction and a secondary scan direction. JP-A-2008-001053 describes creating a test pattern in order to detect misalignment in landing positions.

SUMMARY

Some types of printing apparatus execute pre-processing before printing by ejecting a transparent ink. Misalignment in the landing positions of the transparent ink is preferably also measured using a test pattern.

However, it is difficult to measure the landing positions of transparent ink if the transparent ink is simply ejected onto a print medium as it is. Techniques may be considered in which a base-coat of colored ink is formed and a test pattern is formed on the base-coat using the transparent ink. However, ruled lines of the transparent ink formed on the base-coat may be difficult to see, causing a drop in measurement precision.

An advantage of some aspects of the disclosure is that a test pattern formed from transparent ink is made easier to measure.

One aspect of the present disclosure is a test pattern creation method employing a printing apparatus including a transparent ink print head that ejects a transparent ink, a first print head that ejects a first colored ink, and a second print head that ejects a second colored ink. The creation method includes forming a base-coat on a print medium using the first colored ink, and creating, as plural ruled lines to measure impact displacement of the transparent ink, a first ruled line set formed by layering the transparent ink over the base-coat, and a second ruled line set formed outside a region corresponding to the base-coat using the second colored ink. Since the ink color of the base-coat and the ink color of the second ruled line set are different to each other, this configuration enables the ink color of the base-coat and the ink color of the second ruled line set to be selected such that the first and second ruled line sets are easy to detect.

In one aspect, the first ruled line set and the second ruled line set are employed to measure impact displacement arising as a result of head misalignment of the transparent ink print head with respect to the second print head in a primary scan direction. This configuration enables impact displacement in the primary scan direction to be detected.

In one aspect, a first print tip and a second print tip are provided to the transparent ink print head. The first print tip is provided with plural nozzles configuring a first nozzle row arranged along a secondary scan direction and a second nozzle row positioned on a predetermined side of the first nozzle row in the primary scan direction. As locations to measure impact displacement in the primary scan direction, the test pattern includes at least one out of: a location to measure impact displacement arising as a result of tip misalignment of the first print tip and the second print tip; a location to measure impact displacement arising as a result of forward/reverse misalignment of an forward pass and a reverse pass of a primary scan; a location to measure impact displacement arising as a result of row misalignment of the first nozzle row and the second nozzle row; a location to measure impact displacement arising as a result of positional misalignment of the transparent ink print head in a rotation direction about the primary scan direction; or a location to measure impact displacement arising as a result of positional misalignment of the transparent ink print head in a rotation direction about a direction orthogonal to both the primary scan direction and the secondary scan direction. This configuration enables various types of impact displacement to be detected.

In one aspect, the first ruled line set and the second ruled line set are employed to measure impact displacement arising as a result of head misalignment of the transparent ink print head with respect to the second print head in a secondary scan direction. This configuration enables impact displacement in the secondary scan direction to be detected.

In one aspect, the transparent ink print head is provided with a first print tip and a second print tip. The test pattern preferably includes a location to measure impact displacement arising as a result of tip misalignment of the first print tip and the second print tip in a secondary scan direction. This configuration enables impact displacement arising as a result of tip misalignment between the print tips in the secondary scan direction to be detected.

In one aspect, the method further includes creating, as plural ruled lines to measure impact displacement of the first colored ink, a third ruled line set formed using the first colored ink, and a fourth ruled line set formed using the second colored ink, with both the third ruled line set and the fourth ruled line set being formed outside the region corresponding to the base-coat. This configuration enables impact displacement of the first colored ink to be detected.

In on aspect, a spacing between ruled lines in the first ruled line set is wider than a spacing between ruled lines in the third ruled line set. The first ruled line set is formed by layering the transparent ink over the base-coat, and is therefore liable to bleed. Since the spacing between the ruled lines is wide, this configuration makes the positions of the ruled lines easy to detect, even if the ruled lines configuring the first ruled line set bleed.

In one aspect, secondary scan direction positions of the first ruled line set and the second ruled line set at least partially overlap with secondary scan direction positions of the third ruled line set and the fourth ruled line set. This configuration enables the first to the fourth ruled line sets to be formed during the same primary scan for the portions at overlapping positions in the secondary scan direction.

In one aspect, the printing apparatus includes a third print head that ejects a third colored ink, and the second ruled line set is formed after deciding to employ the second colored ink to form the second ruled line set based on a comparison of usage frequencies of the second colored ink and the third colored ink in printing by the printing apparatus. This configuration enables the ink color employed for the second ruled line set to be decided based on the usage frequency of the colored inks.

The present disclosure may be implemented in various ways other than those described above. For example, the present disclosure may be implemented by the above test pattern, a printing system, a program that implements the above creation method, a non-transient storage medium stored with the aforementioned program, or the like.

BRIEF DESCRIPTION OF THE DRAWINGS

The invention will be described with reference to the accompanying drawings, wherein like numbers reference like elements.

DETAILED DESCRIPTION

Figure 1:
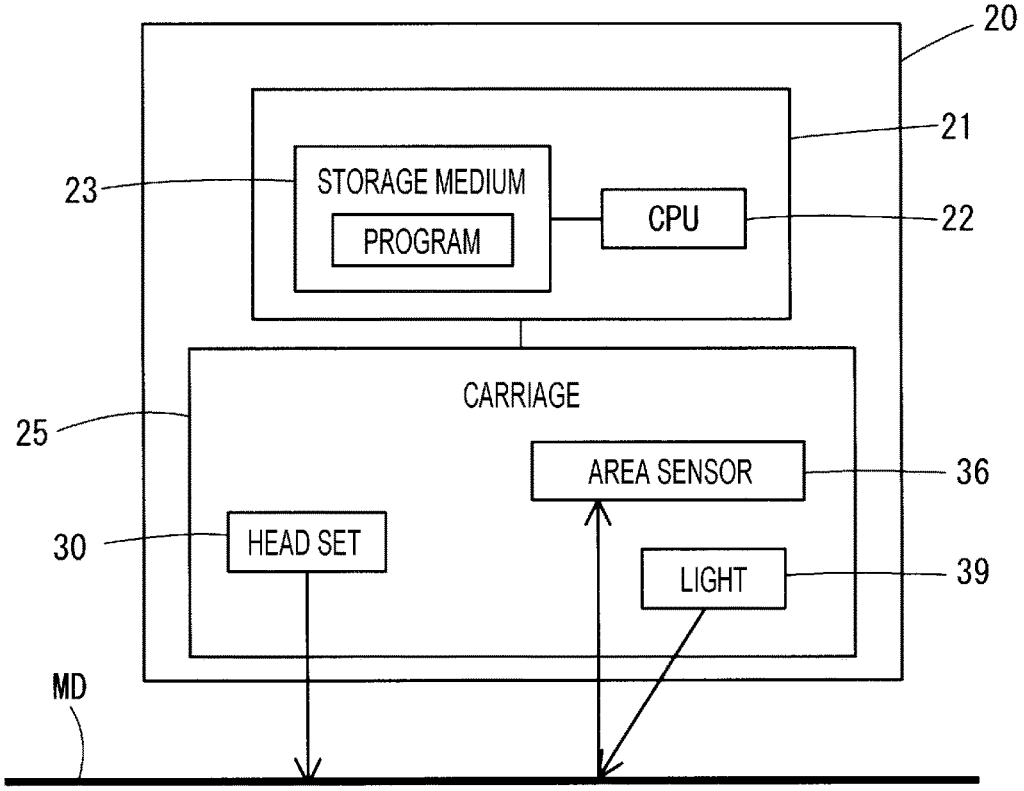
FIG. 1 is a functional block diagram of a printing apparatus.

A first embodiment will next be described. FIG. 1 is a functional block diagram of a printing apparatus 20. In addition to normal printing functionality, as described later the printing apparatus 20 includes functionality to measure impact displacement, and therefore falls under the broad definition of a printing system.

The printing apparatus 20 includes a controller 21 and a carriage 25. The controller 21 includes a CPU 22 and a storage medium 23. The carriage 25 includes a print head set 30, an area sensor 36, and a light 39.

The printing apparatus 20 ejects ink toward a print medium MD, thereby forming dots on the print medium MD. The printing apparatus 20 ejects seven colors of ink. Six out of these seven colors are CMYKLcLm, namely cyan, magenta, yellow, black, light cyan, and light magenta. These six colors are collectively referred to as colored inks.

The one remaining ink is optimizer ink. Optimizer ink is colorless and transparent. Optimizer ink is also referred to as gloss optimizer ink. The optimizer ink is employed in pre-processing prior to printing.

The carriage 25 of the printing apparatus 20 scans in a primary scan direction in order to form the dots, and the print medium MD is transported in a secondary scan direction.

The area sensor 36 measures brightness values of the print medium MD. The light 39 illuminates light toward a measurement range of the area sensor 36. The measurements taken by the area sensor 36 are employed in impact displacement amount measurement processing, described later.

The dot formation and brightness value measurements mentioned above are controlled by the CPU 22. The storage medium 23 is stored with a program used to implement printing processing, described later. The printing processing is processing to form the aforementioned dots and measure the brightness values.

Figure 2:
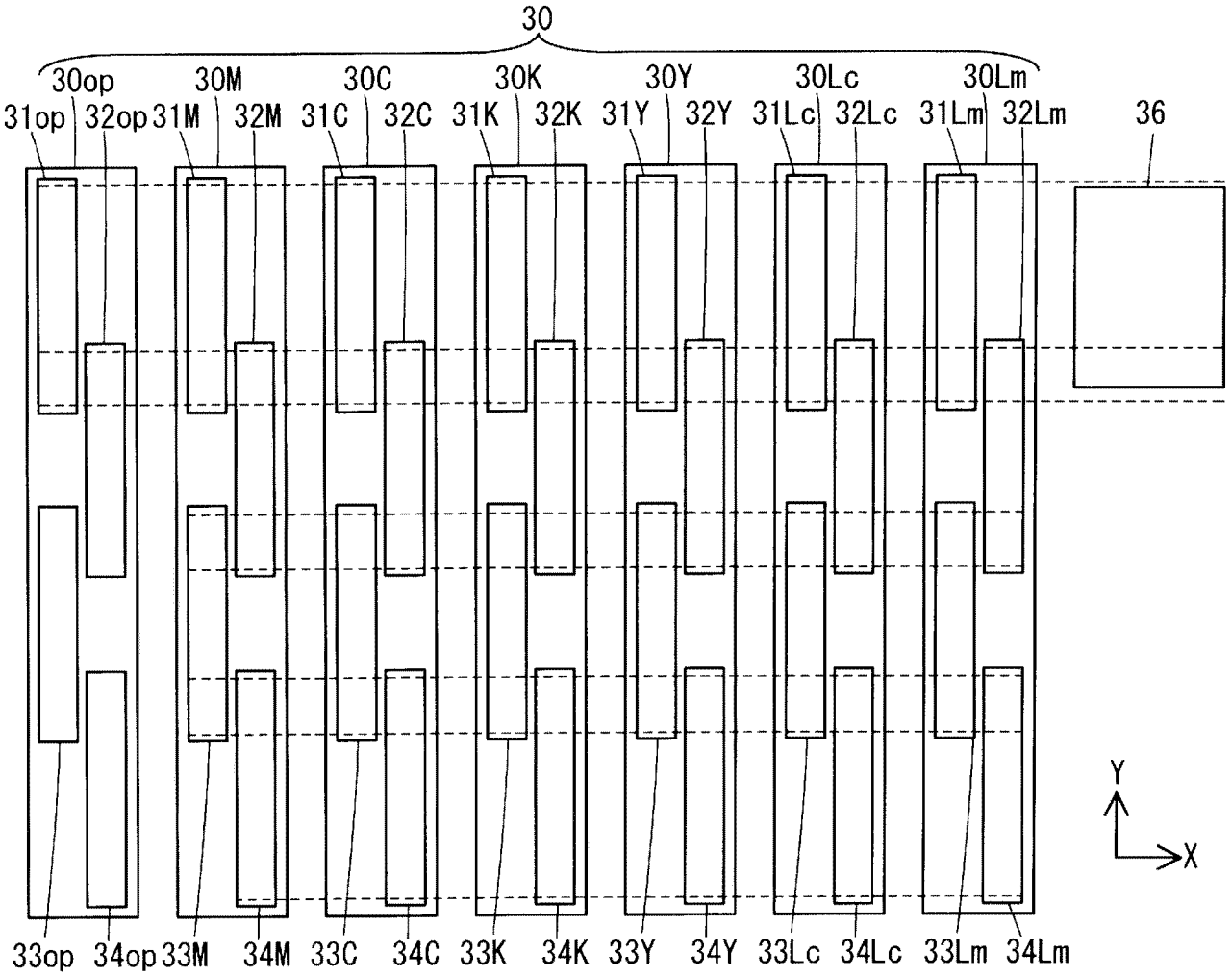
FIG. 2 is a diagram illustrating a print head set.

FIG. 2 illustrates the print head set 30. An XY coordinate system is illustrated in FIG. 2. The X direction represents the primary scan direction. A primary scan toward the positive side in the X direction is also referred to as an forward pass primary scan. A primary scan toward the negative side in the X direction is also referred to as a reverse pass primary scan.

The Y direction represents the secondary scan direction. The positive side in the Y direction represents the secondary scan downstream side. Namely, the print medium MD is transported from the lower side toward the upper side in FIG. 2.

The print head set 30 is configured to include a magenta print head 30M, a cyan print head 30C, a black print head 30K, a yellow print head 30Y, a light cyan print head 30Lc, a light magenta print head 30Lm, and an optimizer print head 30*op*.

In the following explanation, the magenta print head 30M is taken as an example. With the exception of the difference in ink color, the following explanation regarding the print head is common to each of the print heads. The magenta print head 30M includes a first print tip 31M to a fourth print tip 34M.

Figure 3:
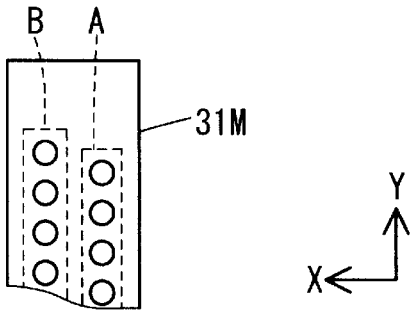
FIG. 3 is a diagram illustrating a first print tip as viewed from the side of a print medium.

FIG. 3 is a diagram illustrating the first print tip 31M as viewed from the print medium MD side. The first print tip 31M is provided with plural nozzles NZ. Ink droplets are ejected through each of the nozzles NZ.

The nozzles NZ are provided in two rows, as illustrated in FIG. 3. Of the rows formed by the nozzles, a row positioned on the X direction negative side is referred to as nozzle row A, and a row positioned on the X direction positive side is referred to as nozzle row B. The second print tip 32M to the fourth print tip 34M are each provided with nozzles configured similarly to those of the first print tip 31M.

The first print tip 31M to the fourth print tip 34M each include overlapping regions. Overlapping regions are regions in which dots can be formed by either of two different print tips mounted on the same print head. The second print tip 32M includes overlapping regions with both the first print tip 31M and the third print tip 33M. The third print tip 33M also includes an overlapping region with the fourth print tip 34M.

In the following explanation, the regions that are not overlapping regions are referred to as solitary regions. In FIG. 2, boundaries between the overlapping regions and the solitary regions are indicated by dashed lines.

Figure 4:
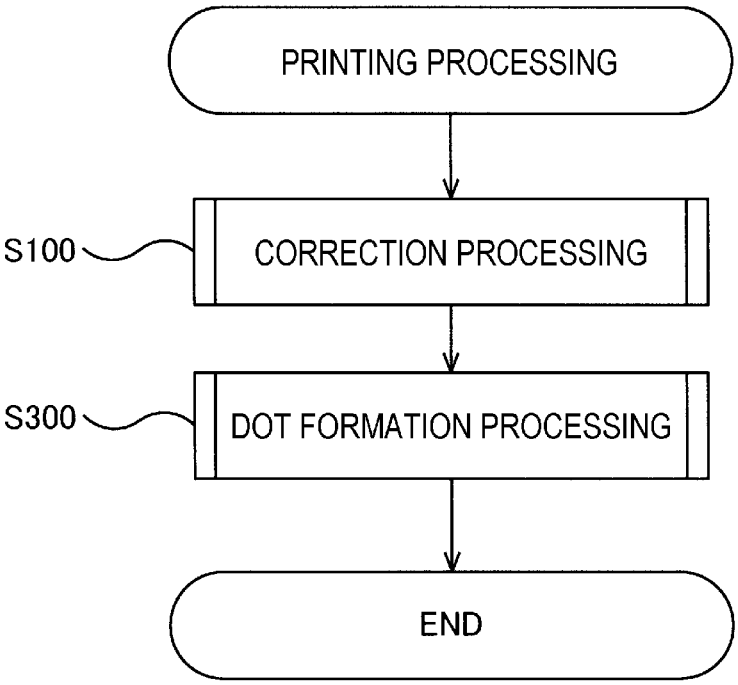
FIG. 4 is a flowchart illustrating printing processing.

FIG. 4 is a flowchart illustrating the printing processing. The printing processing is executed by the CPU 22. Correction processing (S100) is executed after starting the printing processing. The correction processing is processing to correct impact displacement in the optimizer ink.

Figure 5:
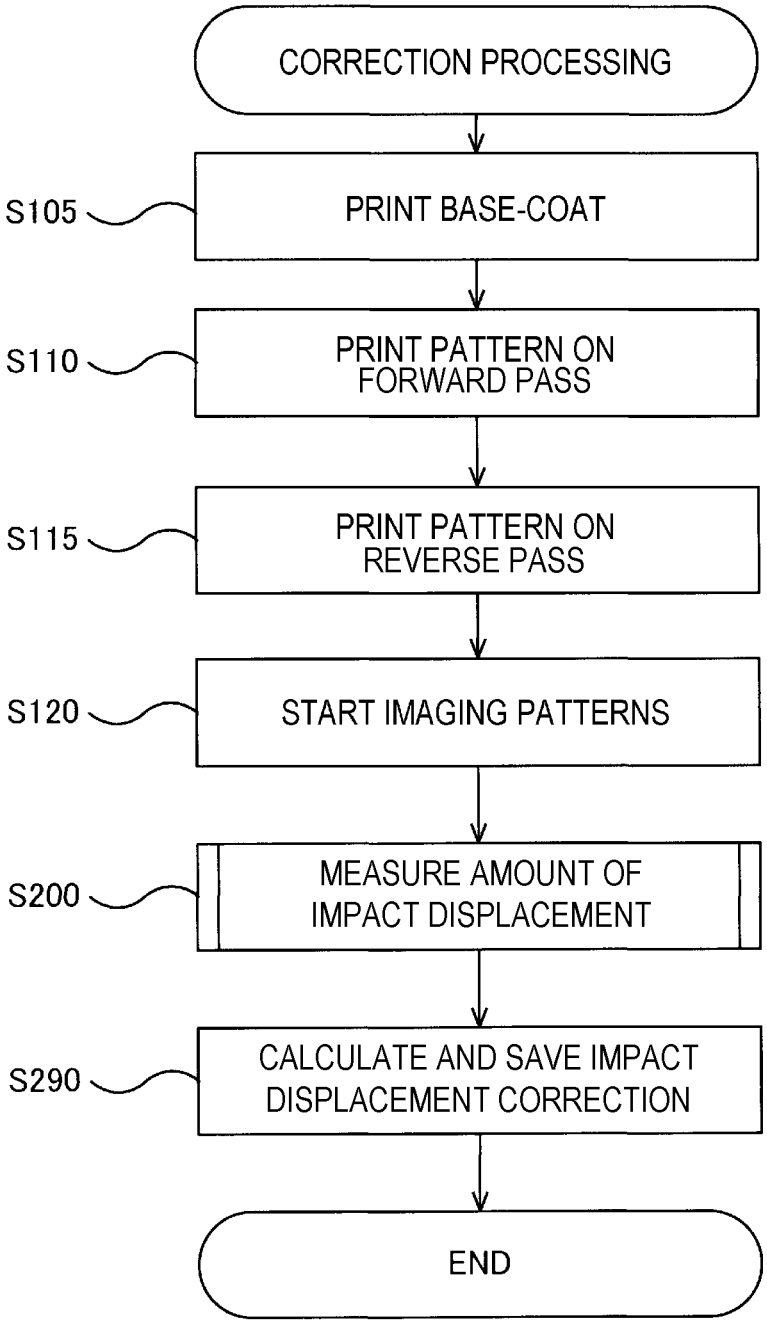
FIG. 5 is a flowchart illustrating correction processing.

FIG. 5 is a flowchart illustrating the correction processing. First, a base-coat G (FIG. 6) is printed on the print medium MD (S105). The base-coat G is printed on an forward pass primary scan.

Next, a test pattern 40 and part of a test pattern 50 are printed on an forward pass primary scan (S110). The remainder of the test pattern 50 is then printed on the reverse pass of the primary scan (S115). The entire test pattern 40 and entire test pattern 50 are created by S105, S110, and S115.

Figure 6:
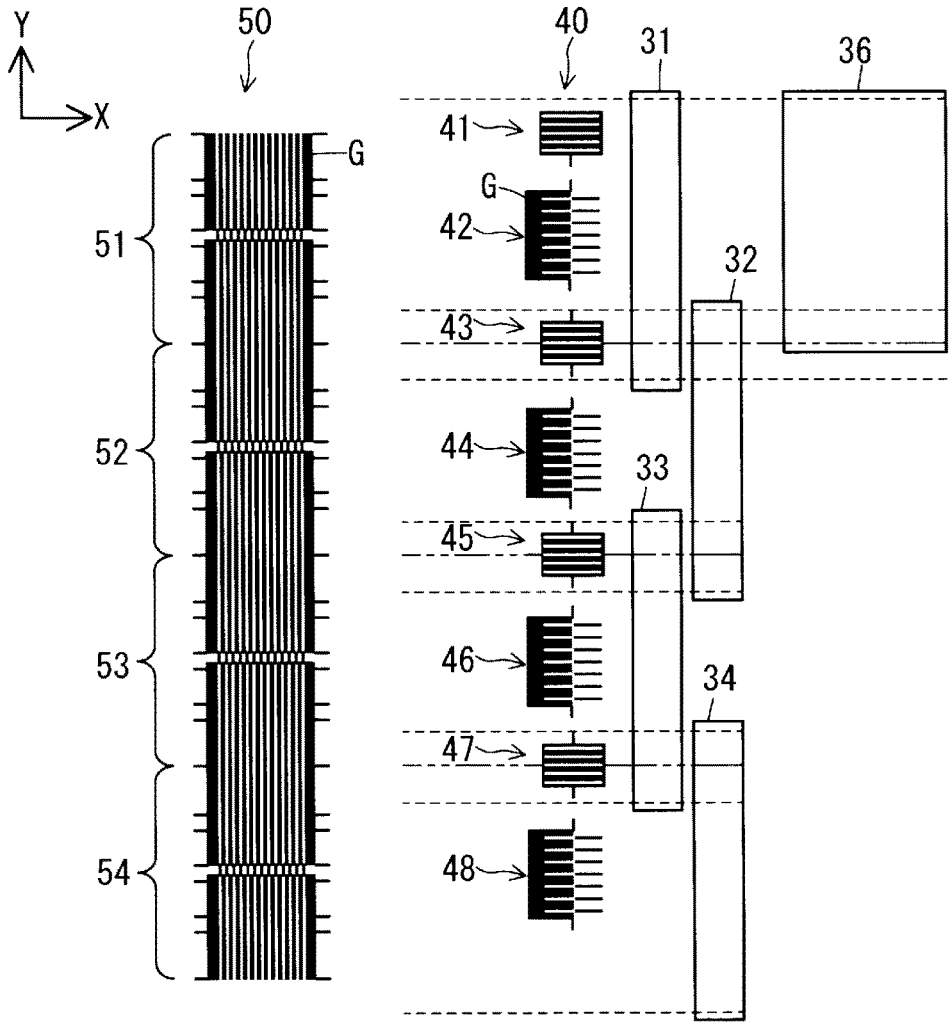
FIG. 6 is a diagram illustrating test patterns.

FIG. 6 illustrates the test patterns 40, 50. The test pattern 40 is used to measure Y direction impact displacement. The test pattern 50 is used to measure X direction impact displacement.

The base-coat G is configured to include filled regions in the respective test patterns 40, 50. The base-coat G is formed by solid block-filling. The base-coat G of the present embodiment is formed using black ink. Lines formed within the base-coat G regions are formed using the optimizer ink. Lines formed outside of the base-coat G regions are formed using cyan ink or black ink.

FIG. 6 illustrates the first to fourth print tips 31 to 34 and the area sensor 36 in order to illustrate positional relationships between the test patterns 40, 50 in the Y direction. The "first print tips 31" refer to the first print tips mounted to each of the seven heads when not distinguishing between the respective print tips. The same applies for the second to fourth print tips 32 to 34.

The test pattern 40 is configured to include a first sector 41 to an eighth sector 48. The first sector 41 to the eighth sector 48 are each formed at a different position in the Y direction.

The second sector 42, the fourth sector 44, the sixth sector 46, and the eighth sector 48 are formed by ink ejected from nozzles contained in solitary regions. These sectors are collectively referred to below as head sectors. The head sectors are sectors used to measure impact displacement between the print heads.

The third sector 43, the fifth sector 45, and the seventh sector 47 are formed by ink ejected from nozzles contained in overlapping regions. These sectors are collectively referred to below as tip sectors. The tip sectors are sectors used to measure impact displacement between the print tips.

Although the first sector 41 also configures part of the test pattern 40, it is not used to measure impact displacement amounts.

The test pattern 50 is divided into four regions in the Y direction. The four regions are a first sector 51, a second sector 52, a third sector 53, and a fourth sector 54, as illustrated in FIG. 6. A boundary between the first sector 51 and the second sector 52 is in the vicinity of the center of the overlapping region between the first print tip 31 and the second print tip 32 in the Y direction. A boundary between the second sector 52 and the third sector 53 is in the vicinity of the center of the overlapping region between the second print tip 32 and the third print tip 33 in the Y direction. A boundary between the third sector 53 and the fourth sector 54 is in the vicinity of the center of the overlapping region between the third print tip 33 and the fourth print tip 34 in the Y direction.

The first sector 51 is formed by ink ejected from nozzles provided to the first print tip 31. Likewise, the second sector 42 to the fourth sector 44 are formed by ink ejected from nozzles provided to the second print tip 32 to the fourth print tip 34 respectively. Details of the test patterns 40, 50, including regarding impact displacement measurement, will be described later.

Next, imaging of the test patterns 40, 50 is started (S120). Imaging of the test patterns 40, 50 is performed using a combination of primary scanning and secondary scanning. Secondary scanning is performed in order to respectively bring the first sector 51 to the fourth sector 54 within an imaging range. This secondary scanning brings two sectors of the test pattern 40 into the imaging range at the same time. For example, the first sector 51, as well as the first sector 41 and the second sector 42, are imaged with the area sensor 36 at the same Y direction position with respect to the print medium MD.

After imaging of the test patterns 40, 50 has started, once imaging of a first location has been completed, measurement of impact displacement amounts commences in parallel with imaging of the other sectors (S200).

Figure 7:
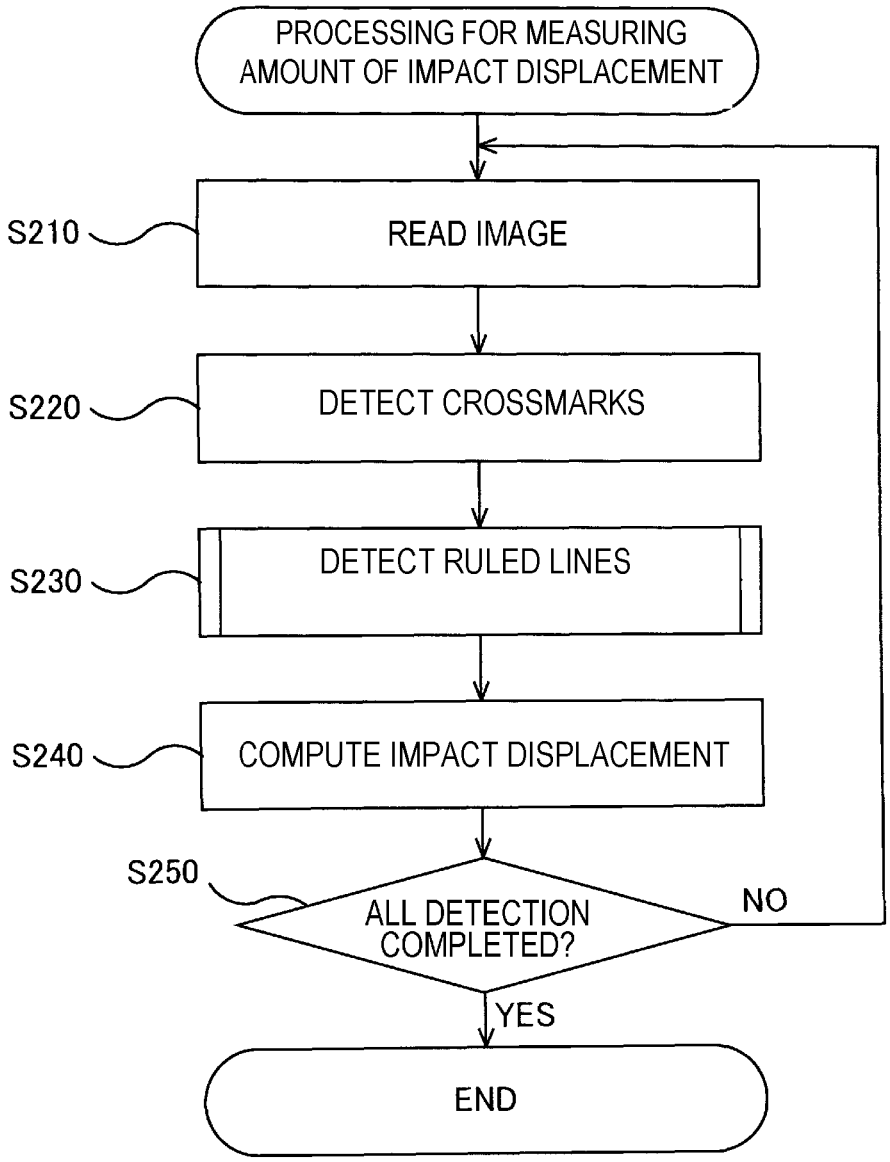
FIG. 7 is a flowchart illustrating impact displacement amount measurement processing.

FIG. 7 is a flowchart illustrating the impact displacement amount measurement processing. The impact displacement amount measurement processing is processing to measure impact displacement amounts in both the X direction and the Y direction using the test patterns 40, 50.

First, a captured image is read (S210). Then, crossmarks are detected (S220). First, details of the test pattern 50, including regarding the crossmarks, will be explained. The test pattern 40 will be explained later.

Figure 8:
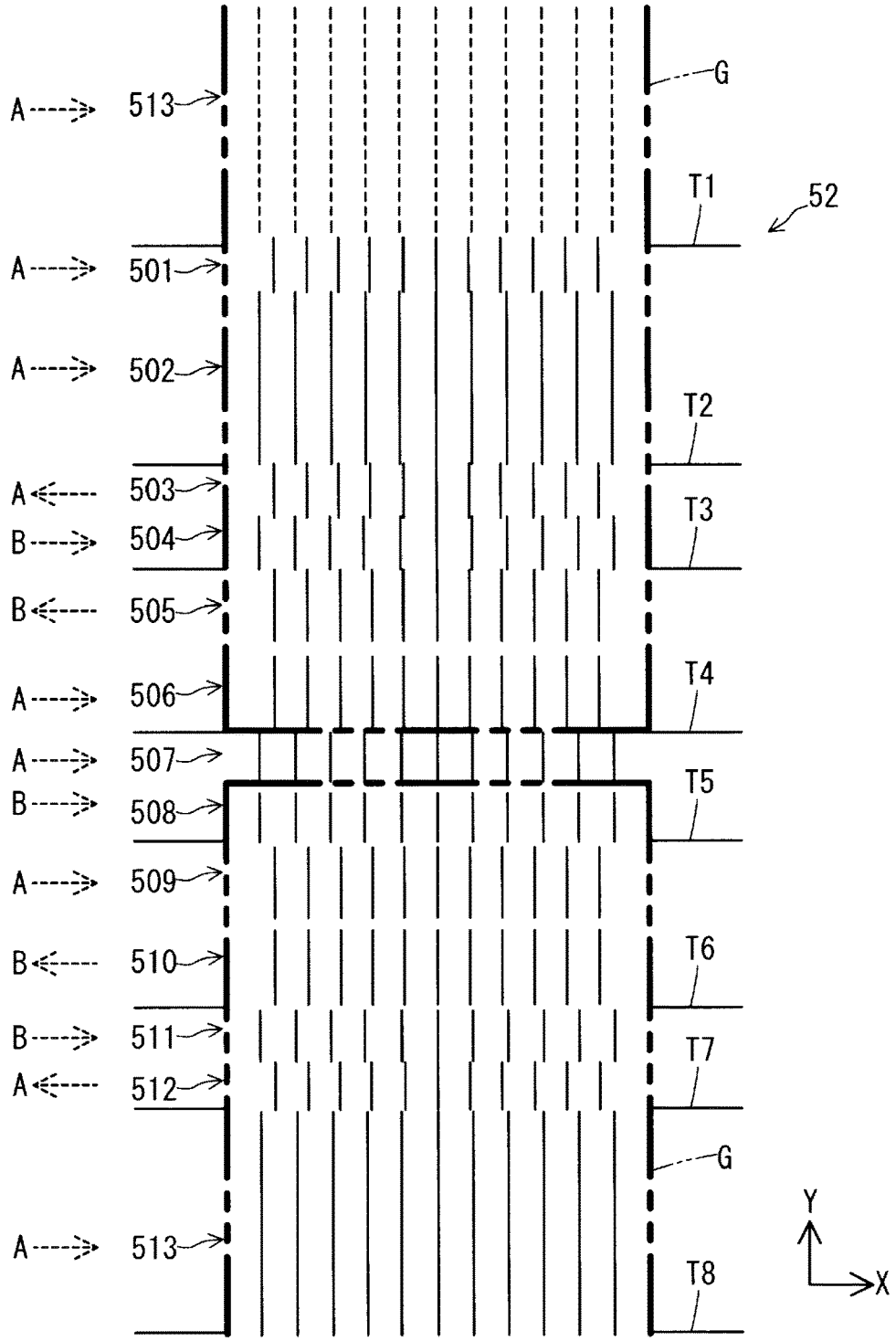
FIG. 8 is a diagram illustrating a second sector of a test pattern used for a primary scan direction.

FIG. 8 illustrates the second sector 52 as a representative of the four sectors of the test pattern 50. The other sectors each have the same configuration as the second sector 52, except where explicitly stated.

In FIG. 8, the outlines of the base-coat G are illustrated by double-dotted dashed lines. Moreover, in FIG. 8, lines formed using the optimizer ink are illustrated in black.

The second sector 52 is configured to include a first ruled line set 501 to a thirteenth ruled line set 513, as well as plural crossmarks. Each of the first ruled line set 501 to the thirteenth ruled line set 513 is configured to include eleven ruled lines. The ruled lines are formed as parallel lines running along the Y direction provided that no roll or yaw, described later, is present.

Note that both a thirteenth ruled line set 513 with ruled lines illustrated by unbroken lines, and a thirteenth ruled line set 513 with ruled lines illustrated by dashed lines are illustrated. The thirteenth ruled line set 513 of the second sector 52 is illustrated by unbroken lines. The thirteenth ruled line set 513 illustrated by dashed lines belongs to the first sector 51. The thirteenth ruled line set 513 belonging to the first sector 51 is illustrated in order to explain measurement of impact displacement. The thirteenth ruled line set 513 belonging to the first sector 51 is also formed by unbroken lines in reality.

As described above, the second sector 52 is formed using the second print tip 32. The second print tip 32 includes the nozzle row A and the nozzle row B. The second sector 52 is formed by two passes.

The first ruled line set 501, the second ruled line set 502, the fourth ruled line set 504, the sixth ruled line set 506, the seventh ruled line set 507, the eighth ruled line set 508, the ninth ruled line set 509, the eleventh ruled line set 511, and the thirteenth ruled line set 513 are formed on the forward pass of the two passes.

The third ruled line set 503, the fifth ruled line set 505, the tenth ruled line set 510, and the twelfth ruled line set 512 are formed on the reverse pass of the two passes.

The first ruled line set 501, the second ruled line set 502, the third ruled line set 503, the sixth ruled line set 506, the seventh ruled line set 507, the ninth ruled line set 509, the twelfth ruled line set 512, and the thirteenth ruled line set 513 are formed by the nozzle row A.

The fourth ruled line set 504, the fifth ruled line set 505, the eighth ruled line set 508, the tenth ruled line set 510, and the eleventh ruled line set 511 are formed by the nozzle row B.

The first ruled line set 501 to the sixth ruled line set 506 and the eighth ruled line set 508 to the thirteenth ruled line set 513 are formed by a second print tip 32*op* of the optimizer print head 30*op*. On the other hand, the seventh ruled line set 507 is formed by a second print tip 32 provided to a reference print head (referred to below as the "reference head"). In the present embodiment, the reference head is the cyan print head 30C. In the present embodiment, cyan ink is used the least frequently out of the six colors.

In FIG. 8, the forward pass and the reverse pass described above are indicated by arrows. The left-pointing arrows indicate the forward pass. The right-pointing arrows indicate the reverse pass. The nozzle rows are indicated by the letters A and B.

Next, explanation follows regarding the crossmarks. As illustrated in FIG. 8, the second sector 52 includes crossmarks T1 to T8. In FIG. 8, the crossmarks positioned on the negative side in the X direction are not given reference numerals. However, the two lines at each Y direction position form pairs configuring a single crossmark (for example the crossmark T1).

The crossmark T1 indicates a boundary between the first ruled line set 501 and the thirteenth ruled line set 513 of the first sector 51. The crossmark T2 indicates a boundary between the second ruled line set 502 and the third ruled line set 503. The crossmark T3 indicates a boundary between the fourth ruled line set 504 and the fifth ruled line set 505. The crossmark T5 indicates a boundary between the eighth ruled line set 508 and the ninth ruled line set 509. The crossmark T6 indicates a boundary between the tenth ruled line set 510 and the eleventh ruled line set 511. The crossmark T7 indicates a boundary between the twelfth ruled line set 512 and the thirteenth ruled line set 513. The crossmark T8 indicates a boundary between the thirteenth ruled line set 513 and the first ruled line set 501 of the third sector 53.

Spacings between the ruled lines in two adjacent locations on either side of each crossmark differ from each other, thereby enabling impact displacement to be measured. FIG. 8 illustrates a state in which there is no misalignment present. The X direction positions of the central ruled line of each location are accordingly aligned.

Crossmark detection at S220 refers to determining the approximate positions of the crossmarks T1 to T7 in the Y direction. The crossmark T8 is not detected at S220. Note that the crossmark T8 of the second sector 52 doubles as the crossmark T1 of the third sector 53. The crossmark T8 is not detected in any of the sectors.

The crossmarks may be formed using ink of any color. In the present embodiment, the crossmarks are formed using black ink.

Figure 9:
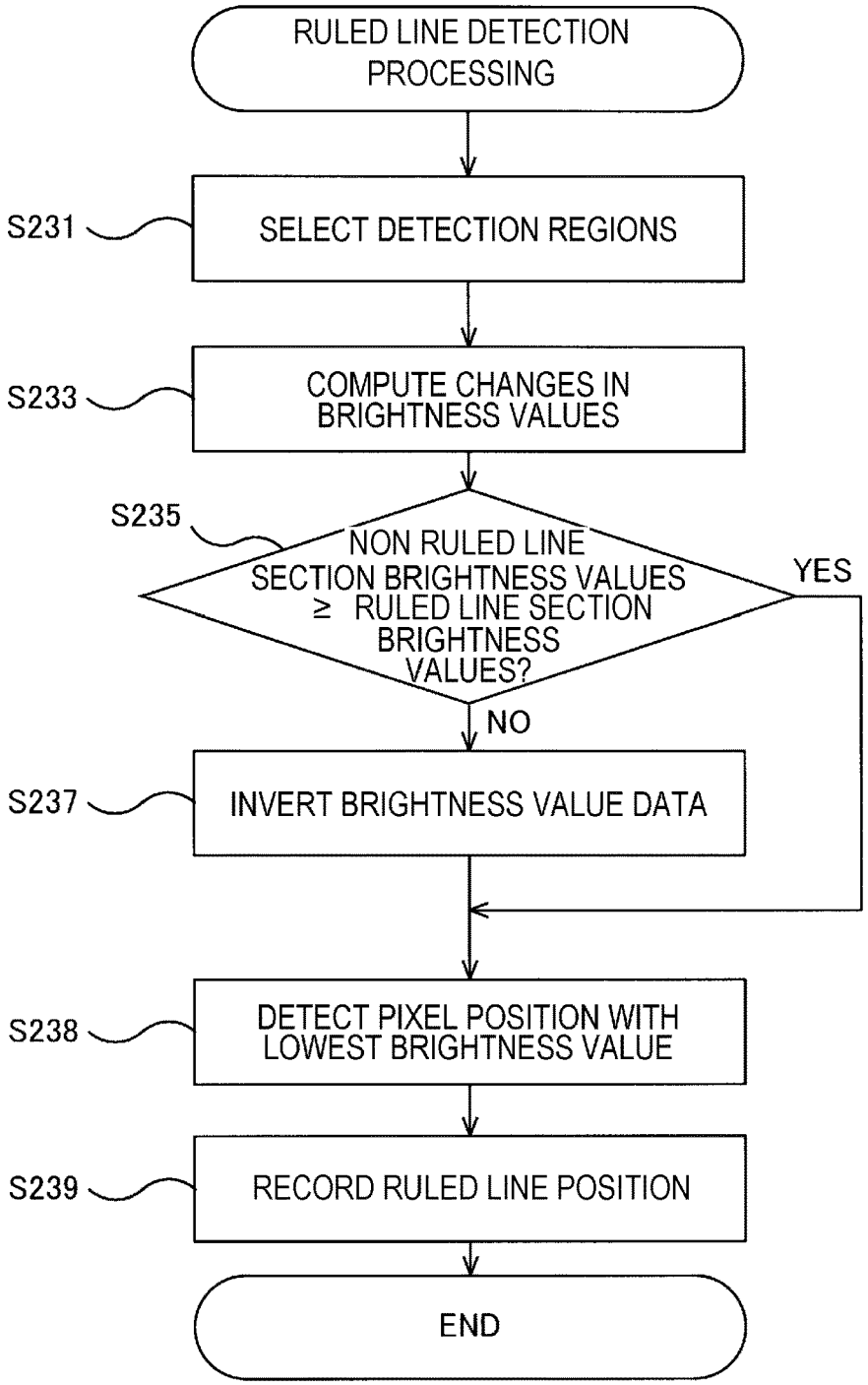
FIG. 9 is a flowchart illustrating ruled line detection processing.

Next, ruled line detection processing is executed (S230). FIG. 9 is a flowchart illustrating ruled line detection processing. First, detection regions KR are selected (S231). Explanation now follows with reference to FIG. 10.

Figure 10:
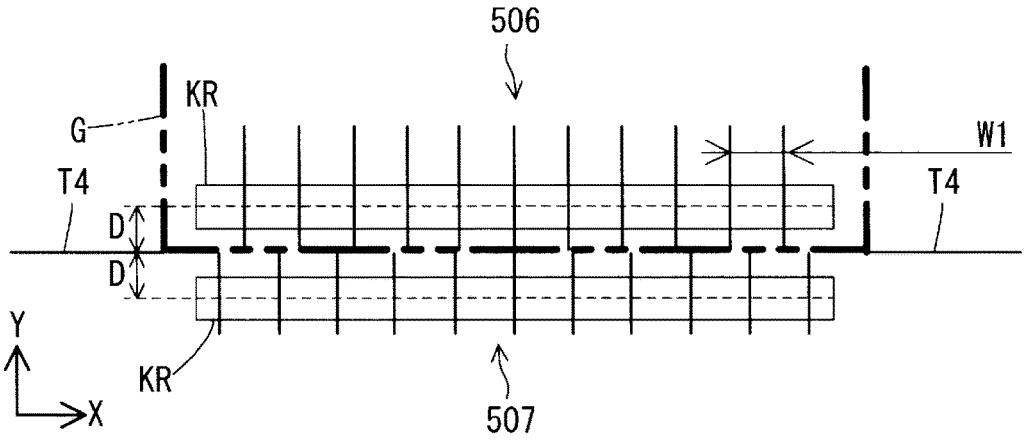
FIG. 10 is a diagram illustrating detection region selection.

FIG. 10 illustrates selection of the detection regions KR using the example of the sixth ruled line set 506 and the seventh ruled line set 507. The selection at S231 is made using the Y direction position of the crossmark T4. Namely, rectangular regions centered on positions respectively offset by a predetermined length D toward the Y direction positive side and the Y direction negative side from the crossmark T4 are selected as the detection regions KR. Note that the spacing between the ruled lines in the sixth ruled line set 506 is a spacing W1.

Next, changes in brightness values are computed (S233). Specifically, first, brightness values within the selected detection regions KR are averaged along a direction parallel to the ruled lines. A change in the brightness values in a direction perpendicular to the ruled lines is then computed as one-dimensional data.

Next, a determination is made as to whether or not brightness values of non-ruled line sections are the brightness values of ruled line sections or greater (S235). Ruled line sections are locations assumed to be ruled lines based on the brightness values. Non-ruled line sections are locations assumed not to be ruled lines based on the brightness values.

Figure 11:
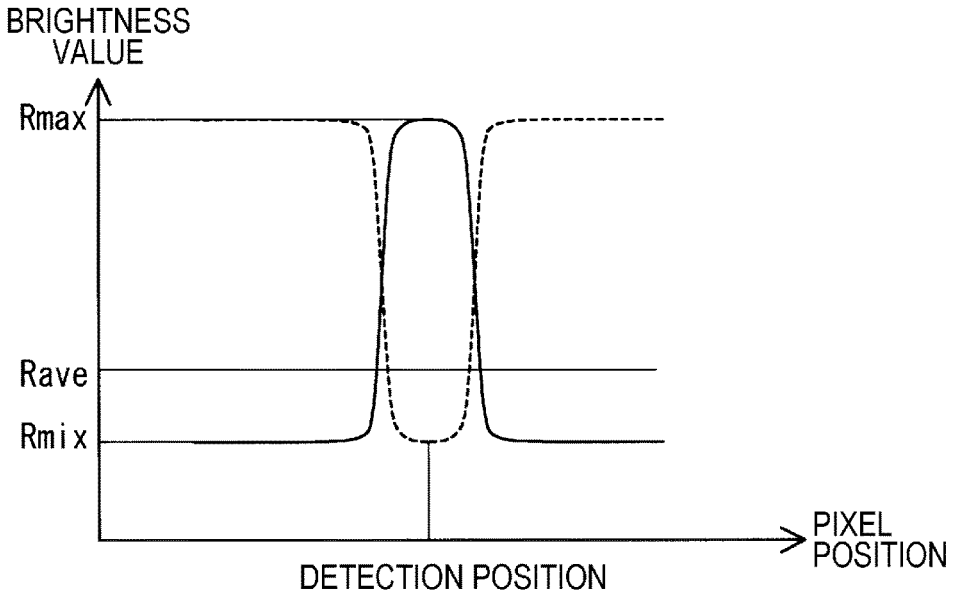
FIG. 11 is a graph illustrating an example of a relationship between brightness values and pixel positions.
Figure 12:
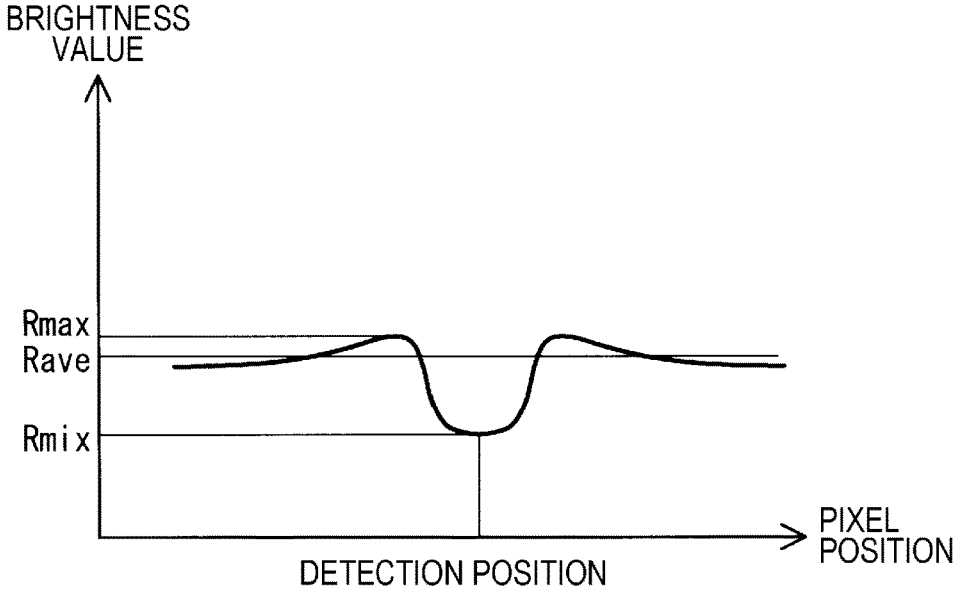
FIG. 12 is a graph illustrating an example of a relationship between brightness values and pixel positions.

FIG. 11 and FIG. 12 are graphs illustrating examples of relationships between brightness values and pixel positions. FIG. 11 and FIG. 12 illustrate pixel positions of a single ruled line and non-ruled line sections around this ruled line in isolation. FIG. 11 illustrates a case in which the brightness value of a ruled line section is greater than the brightness values of the non-ruled line sections. FIG. 12 illustrates a case in which the brightness values of the non-ruled line sections are greater than the brightness value of the ruled line section. The dashed line in FIG. 11 is an inverted brightness value (described later).

In the seventh ruled line set 507, which is formed outside a region corresponding to the base-coat G, the brightness value of the ruled line section is lower than the brightness values of the non-ruled line sections. Namely, the seventh ruled line set 507 exhibits the relationship between brightness values and pixel positions illustrated in FIG. 12.

On the other hand, in the first ruled line set 501 to the sixth ruled line set 506 and in the eighth ruled line set 508 to the thirteenth ruled line set 513, which are formed by printing optimizer ink over the base-coat G, the brightness values of the ruled line sections may sometimes be higher than those of the non-ruled line sections, as illustrated in FIG. 11, and sometimes the opposite is the case, as illustrated in FIG. 12. The relative relationships between brightness values is not uniform since the relationship depends on factors such as the permeability of the ink with respect to the print medium MD.

The determination of S235 is made using Equation (1) below. The determination is YES in cases in which the Equation (1) below is satisfied, and the determination is NO in cases in which the Equation (1) below is not satisfied.

$$Rmax-Rave \geq Rave-Rmin \quad (1)$$

Rmax is a maximum brightness value. Rave is an average brightness value. Rmin is a minimum brightness value.

Equation (1) enables the determination of S235 since the spacings between the ruled lines are set sufficiently wider than the width of the ruled lines. Namely, the average brightness value Rave of the brightness values is affected more by the brightness values of the non-ruled line sections than by the brightness value of the ruled line sections, and so, using the maximum value Rmax and the minimum value Rmin, it can be assumed that non-ruled line sections will be closer to the average brightness value Rave of the brightness values.

In cases in which the brightness values of the non-ruled line sections are lower than the brightness values of the ruled line sections (S235=NO), the brightness value data is inverted (S237). In FIG. 11, the inverted brightness values are illustrated by a dashed line. As illustrated in FIG. 11, the inversion of the present embodiment is performed by taking an intermediate value between the maximum value and the minimum value as a reference.

On the other hand, in cases in which the brightness values of the non-ruled line sections are lower than the brightness values of the ruled line sections (S235=NO), S237 is skipped. As described above, in the case of the seventh ruled line set 507, the determination is NO at S235. When brightness values are handled in this manner based on the relative relationships between the brightness values, the following S238 can be executed in the same manner for both ruled line sets formed within the base-coat G region and for ruled line sets formed outside the base-coat G region.

Next, the pixel position having the lowest brightness value is detected (S238). At S238, statistical processing (for example a moving average) may be employed to correct the detected pixel position as appropriate. Finally, the detected pixel position is stored as a ruled line position (S239), and the ruled line detection processing is ended. A impact displacement amount is then computed (S240).

Note that sometimes, there is a large difference in contrast between ruled line sections and non-ruled line sections depending on whether a ruled line set is formed within a region corresponding to the base-coat G or formed outside of a region corresponding to the base-coat G. If the contrast is large, this could affect the precision with which the positions of ruled line sections are detected. In the present embodiment, assuming that the seventh ruled line set 507 is formed using cyan ink, based on the fact that black ink produces the smallest difference in contrast out of the six colored inks, the base-coat G is formed using black ink.

Explanation follows regarding impact displacement measurement using the first ruled line set 501 to the thirteenth ruled line set 513. Comparing the two sides of the crossmark T1, namely, comparing the positions of ruled lines in the first ruled line set 501 and the thirteenth ruled line set 513 in the first sector 51, enables misalignment between a first print tip 31*op* and the second print tip 32*op* (referred to below as tip misalignment) to be measured. Namely, the first ruled line set 501 and the thirteenth ruled line set 513 are formed using a common method, with the exception that different print tips are employed. Accordingly, any misalignment present can be ascribed to tip misalignment.

Note that in a location belonging to the first sector 51, there is no ruled line formed on the Y direction positive side of the crossmark T1. Accordingly, measurement using the crossmark T1 is not performed at the location belonging to the first sector 51.

Comparing the two sides of the crossmark T2, namely, comparing the positions of ruled lines in the second ruled line set 502 and the third ruled line set 503, enables misalignment between the forward pass and the reverse pass of the nozzle row A (referred to below as "forward/reverse misalignment") to be measured. This is since the second ruled line set 502 and the third ruled line set 503 are formed using a common method, with the only difference being whether the ruled line set is formed on the forward pass or the reverse pass.

Comparing the two sides of the crossmark T3, namely, comparing the positions of ruled lines in the fourth ruled line set 504 and the fifth ruled line set 505, enables forward/reverse misalignment in the nozzle row B to be measured, similarly to using the two sides of the crossmark T2 in the case of the nozzle row A.

Comparing the two sides of the crossmark T4, namely, comparing the positions of ruled lines in the sixth ruled line set 506 and the seventh ruled line set 507, enables misalignment between print heads (referred to below as "head misalignment") to be measured. The sixth ruled line set 506 and the seventh ruled line set 507 are formed using a common method, with the exception that different print heads are employed.

Comparing the two sides of the crossmark T5, namely, comparing the positions of ruled lines in the eighth ruled line set 508 and the ninth ruled line set 509, enables misalignment between the nozzle row A and the nozzle row B (referred to below as "row misalignment") to be measured. The eighth ruled line set 508 and the ninth ruled line set 509 are formed using a common method, with the exception that different nozzle rows are employed.

Comparing the two sides of the crossmark T6, namely, comparing the positions of ruled lines in the tenth ruled line set 510 and the eleventh ruled line set 511, enables forward/reverse misalignment in the nozzle row B to be measured, similarly to in the case of the crossmark T3.

Comparing the two sides of the crossmark T7, namely, comparing the positions of ruled lines in the twelfth ruled line set 512 and the thirteenth ruled line set 513, enables forward/reverse misalignment in the nozzle row A to be measured, similarly to in the case of the crossmark T2.

Explanation follows regarding measurement of other types of misalignment, including explanation regarding the fact that locations used to measure forward/reverse misalignment are provided at two locations for both the nozzle row A and the nozzle row B.

In addition to the above, the test pattern 50 is also used to measure at least the two types of impact displacement described below. The first type is print head yaw. The second type is print head roll. Both of these are types of print head misalignment.

Figure 13:
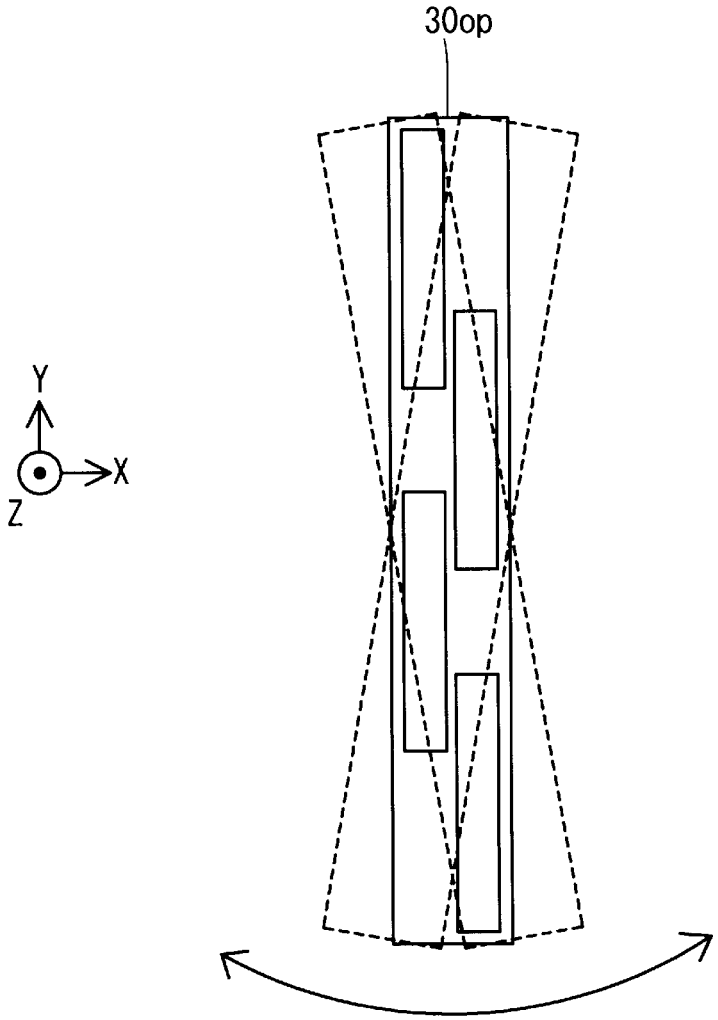
FIG. 13 is a diagram illustrating positional misalignment of a print head in a yaw direction.

FIG. 13 illustrates positional misalignment of the optimizer print head 30*op* in a yaw direction. Yaw is misalignment caused by rotation about the Z direction, as illustrated in FIG. 13. The Z direction is a direction orthogonal to both the X direction and the Y direction. Namely, the Z direction is a direction orthogonal to the printed face of the print medium MD.

Figure 14:
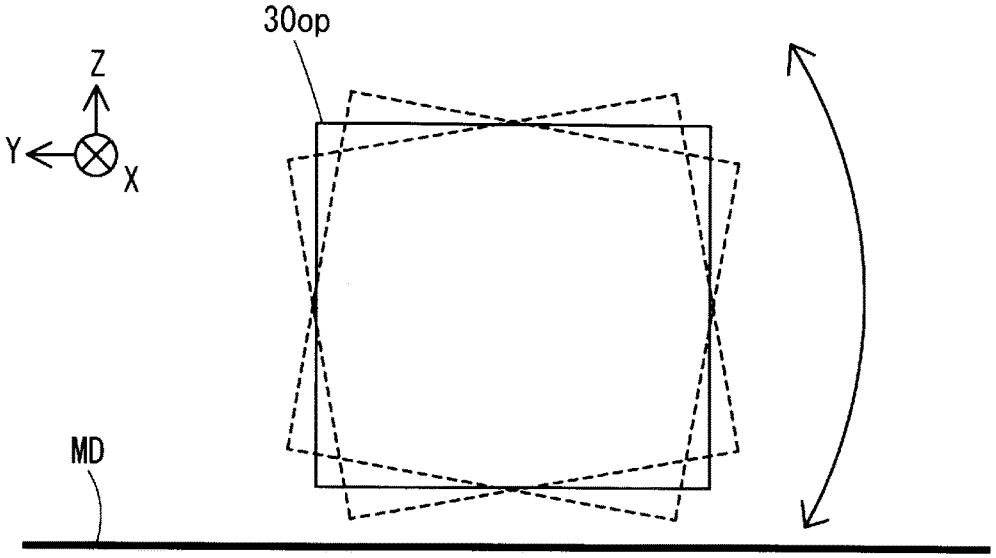
FIG. 14 is a diagram illustrating positional misalignment of a print head in a roll direction.

FIG. 14 illustrates positional misalignment of the optimizer print head 30*op* in a roll direction. Roll is misalignment caused by rotation about the X direction, as illustrated in FIG. 14.

Note that if pitch (misalignment caused by rotation about the Y direction) is measured as head misalignment using the two sides of the crossmark T4, impact displacement can be corrected without impediment, and therefore pitch is not measured as an independent misalignment amount in the present embodiment.

Explanation follows regarding forward/reverse misalignment, followed by detailed explanation regarding yaw and roll.

Figure 15:
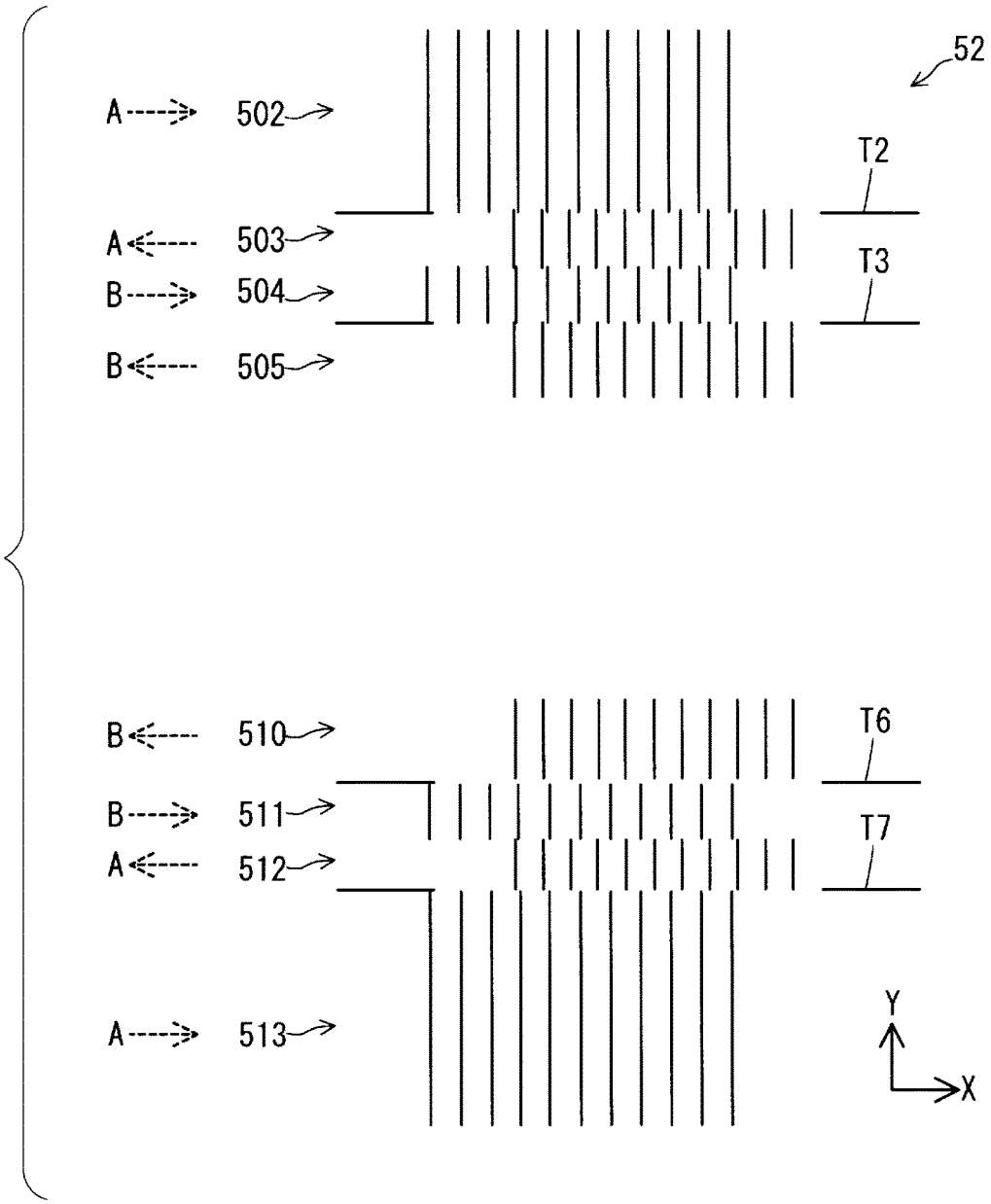
FIG. 15 is a diagram illustrating a second sector created in a case in which forward/reverse misalignment is present.

FIG. 15 illustrates the second sector 52 created in a case in which forward/reverse misalignment is present. Note that the first ruled line set 501, the sixth ruled line set 506, the seventh ruled line set 507, the eighth ruled line set 508, and the ninth ruled line set 509 are not employed in forward/reverse misalignment measurement, and are therefore omitted from illustration in FIG. 15. The base-coat G is also not pertinent to the explanation, and is therefore omitted. These elements are similarly omitted from FIG. 16 and FIG. 17. The second sector 52 illustrated in FIG. 15 assumes that no misalignment other than forward/reverse misalignment is present. Although forward/reverse misalignment also causes misalignment in the X direction positions of the crossmarks, since the X direction positions of the crossmarks are not particularly important here, in FIG. 15, the X direction positions of the crossmarks are illustrated as if no misalignment were present.

As illustrated in FIG. 15, in cases in which forward/reverse misalignment is present, no misalignment is present between the locations formed on the forward pass. Similarly, no misalignment is present between the locations formed on the reverse pass. However, the locations formed on the forward pass are misaligned in the X direction with respect to the locations formed on the reverse pass. Accordingly, forward/reverse misalignment can be measured by using at least one set out of the two sides of the respective crossmarks T2, T3 or the two sides of the respective crossmarks T6, T7.

Figure 16:
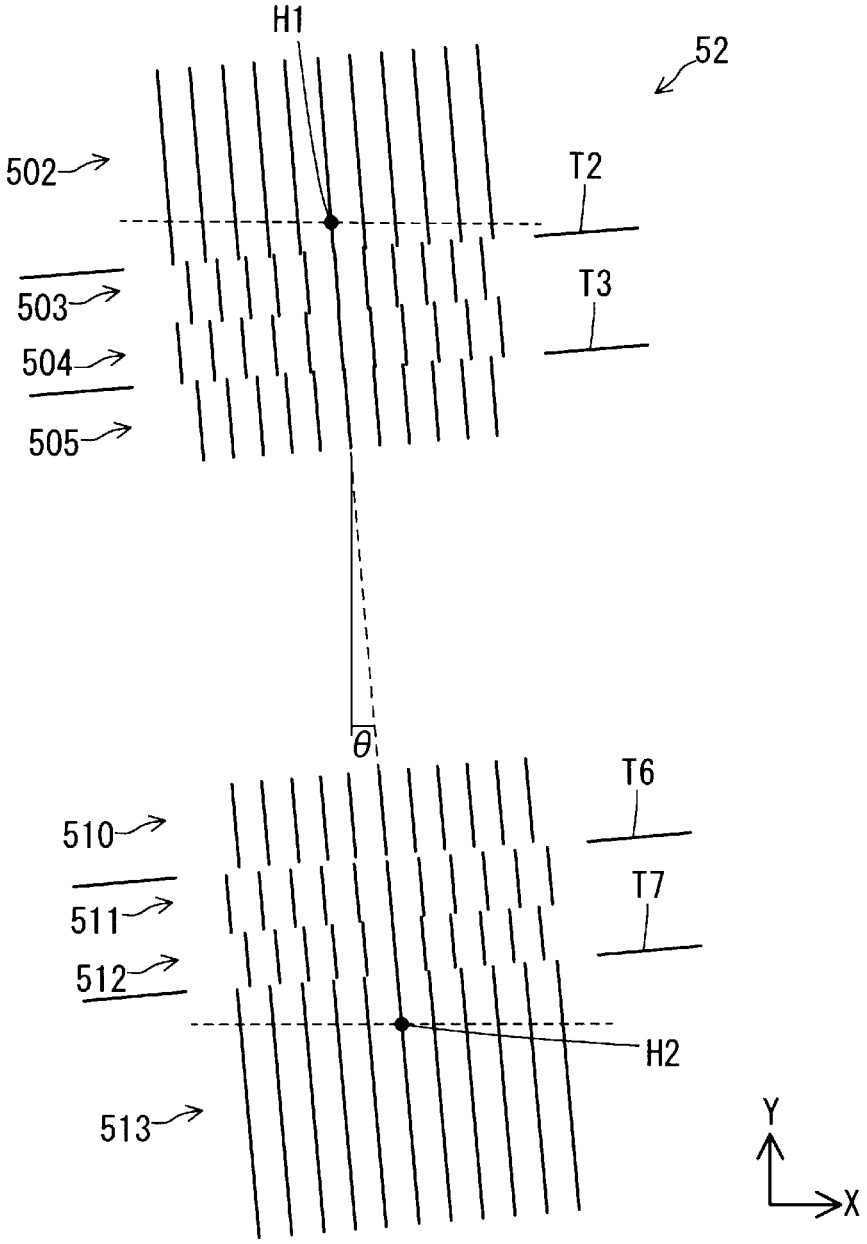
FIG. 16 is a diagram illustrating a second sector created in a case in which yaw is present.

FIG. 16 illustrates the second sector 52 created in a case in which yaw is present. The second sector 52 illustrated in FIG. 16 assumes that no misalignment other than yaw is present. In cases in which yaw misalignment is present, the entire second sector 52 is rotated about the Z direction.

FIG. 16 illustrates two locations formed by each of four formation methods defined by whether the nozzle row A or the nozzle row B is used, and whether the forward pass or the reverse pass is used. For example, both the second ruled line set 502 and the thirteenth ruled line set 513 are formed by the nozzle row A on the forward pass. In the present embodiment, the test pattern 50 is designed such that the respective ruled lines in locations formed using the same formation method are formed at the same position in the X direction provided that no misalignment is present. Namely, the detected positions of corresponding ruled lines will be the same as each other. "Corresponding ruled lines" is a reference to ruled lines arranged at the same position (referred to below as the "arrangement position") in the X direction, for example the respective ruled lines positioned furthest to the positive side in the X direction, or the respective ruled lines positioned at the X direction center.

In cases in which yaw misalignment is present, as long as no misalignment other than yaw is present, an angle measured using corresponding ruled lines out of ruled lines at locations formed by the same formation method will be equal to a rotation angle of the yaw.

In FIG. 16, an angle θ is illustrated as a rotation angle measurement result taken using a central ruled line. The angle θ is an angle formed between the Y direction and a predetermined line segment. The predetermined line segment is a line segment joining a detection position H1 of the second ruled line set 502 to a detection position H2 of the thirteenth ruled line set 513.

Note that as long as no misalignment other than yaw is present, the same angle will be formed regardless of the arrangement position of the ruled lines employed as corresponding ruled line. Moreover, as long as no misalignment other than yaw is present, the same angle will be formed by locations formed using any of the four formation methods using the nozzle row A or the nozzle row B and the forward pass or the reverse pass. The misalignment amount resulting from yaw can be computed as long as this rotation angle can be ascertained.

Figure 17:
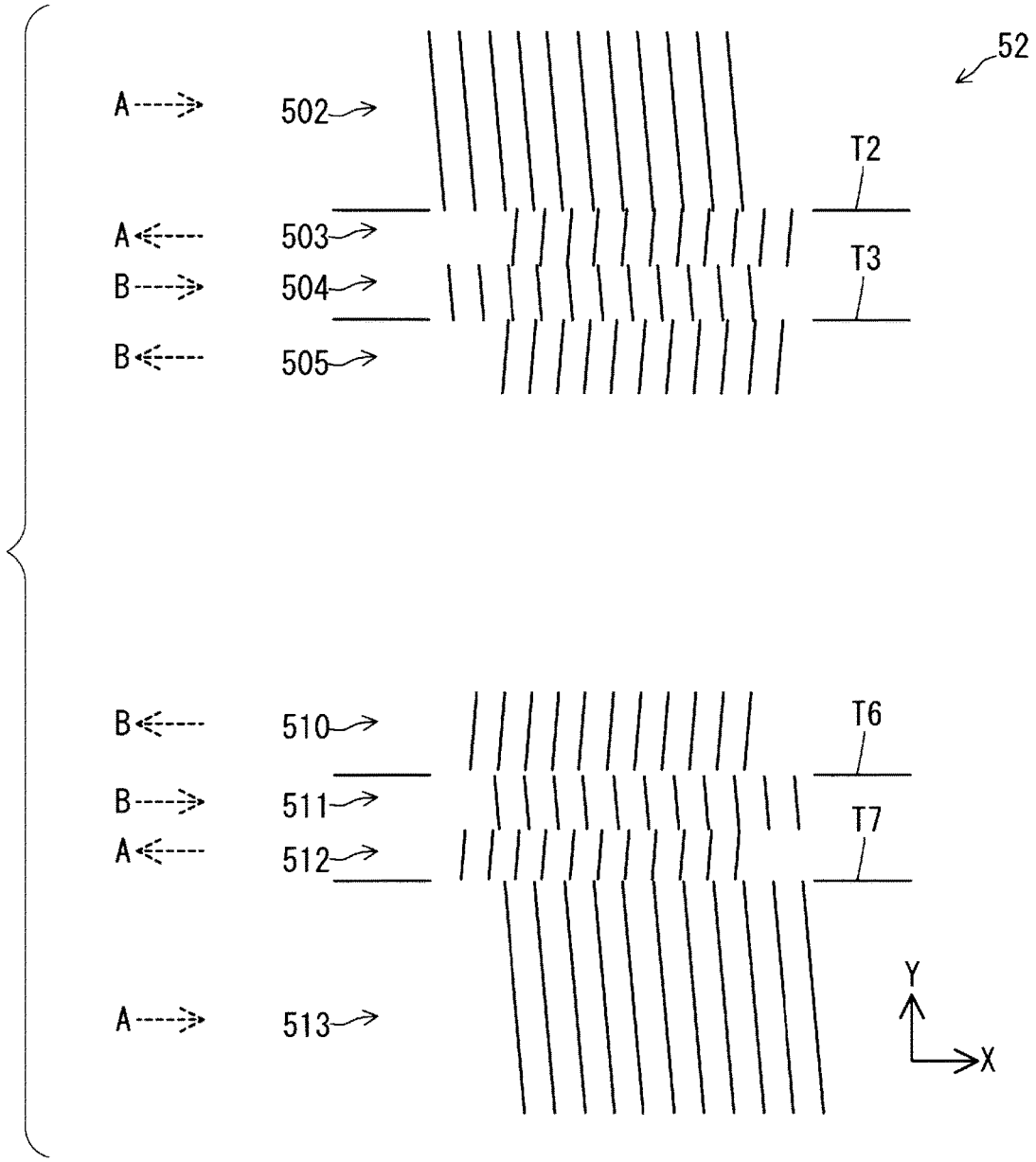
FIG. 17 is a diagram illustrating a second sector created in a case in which roll is present.

FIG. 17 illustrates the second sector 52 created in a case in which roll is present. The second sector 52 illustrated in FIG. 17 assumes that no misalignment other than roll is present. Although roll misalignment also causes misalignment in the crossmark positions, similarly to FIG. 15, in FIG. 17, the positions of the crossmarks are illustrated as if no misalignment were present.

In cases in which roll misalignment is present, each location is rotated about the Z direction. However, the locations formed on the forward pass and the locations formed on the reverse pass are rotated in opposite directions to each other.

If FIG. 15 and FIG. 17 are compared, measurements indicate similar misalignment to be present on the two sides of the respective crossmarks T2, T3. Accordingly, in cases in which only the two sides of the respective crossmarks T2, T3 are employed, it is difficult to differentiate between forward/reverse misalignment and roll misalignment. However, when compared against the two sides of the respective crossmarks T6, T7, the misalignment relationship is reversed. Accordingly, employing both the two sides of the respective crossmarks T2, T3 and the two sides of the respective crossmarks T6, T7 enables forward/reverse misalignment and roll misalignment to be differentiated.

Even on the premise that forward/reverse misalignment, yaw misalignment, and roll misalignment could all be present together, using the relationships described above enables each of the three types of misalignment to be identified using the detection positions of the two sides of the respective crossmarks T2, T3, T6, and T7.

Explanation now turns from the test pattern 50 to the test pattern 40. At each step in the correction processing, except where specifically described, the difference between the test pattern 40 and the test pattern 50 may be understood by switching the X direction and the Y direction. Detailed explanation follows regarding the test pattern 40.

Figure 18:
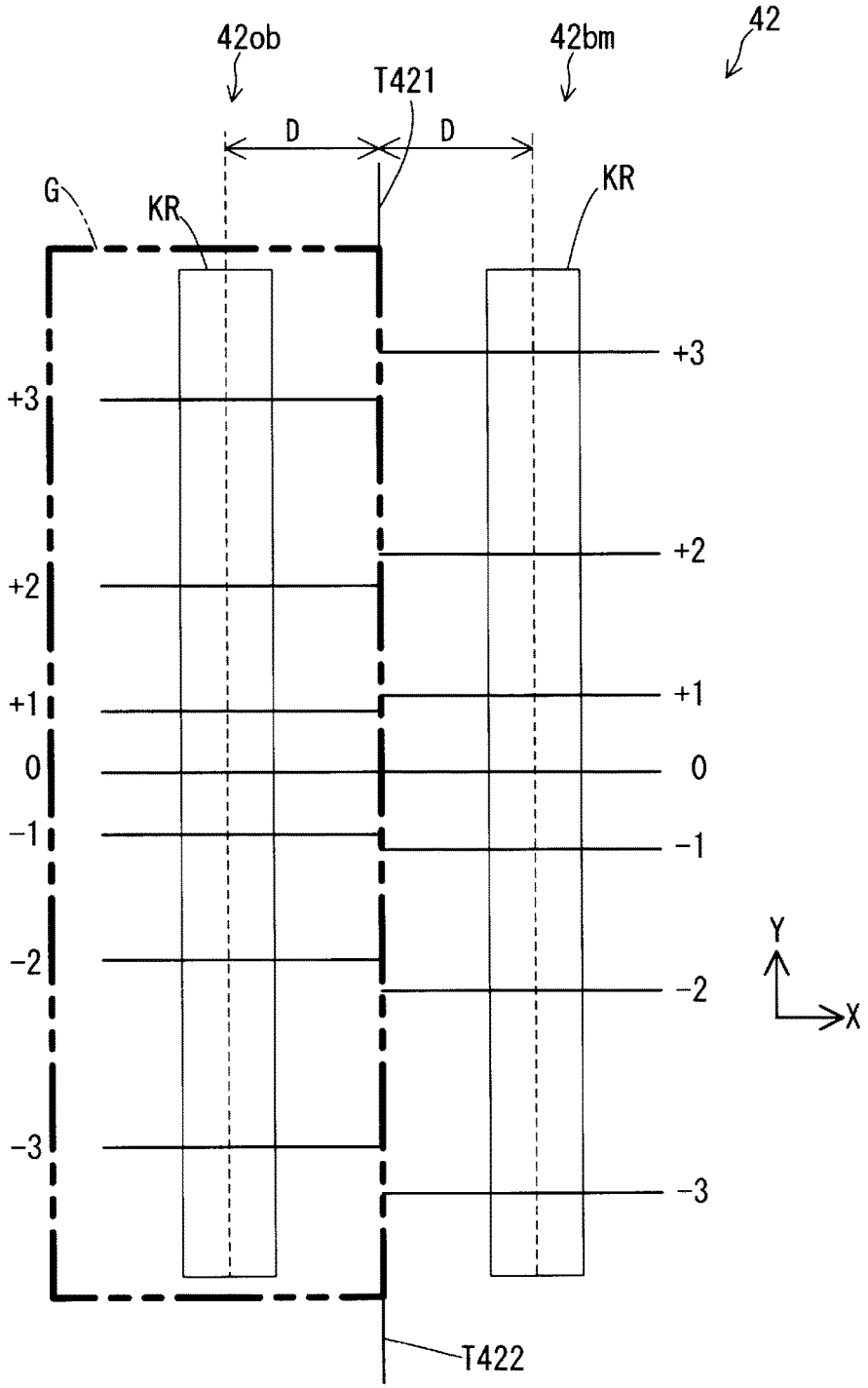
FIG. 18 is a diagram illustrating a second sector in a test pattern used to measure misalignment in a secondary scan direction.

FIG. 18 illustrates the second sector 42. Similarly to FIG. 8, in FIG. 18 and FIG. 19 (described later) the outline of the base-coat G is illustrated by double-dotted dashed lines, and lines formed using the optimizer ink are illustrated in black.

The second sector 42 is configured to include a reference ruled line set 42*bm*, a measurement ruled line set 42*ob*, a crossmark T421, and a crossmark T422. Together, the reference ruled line set 42*bm* and the measurement ruled line set 42*ob* form a pair.

Figure 19:
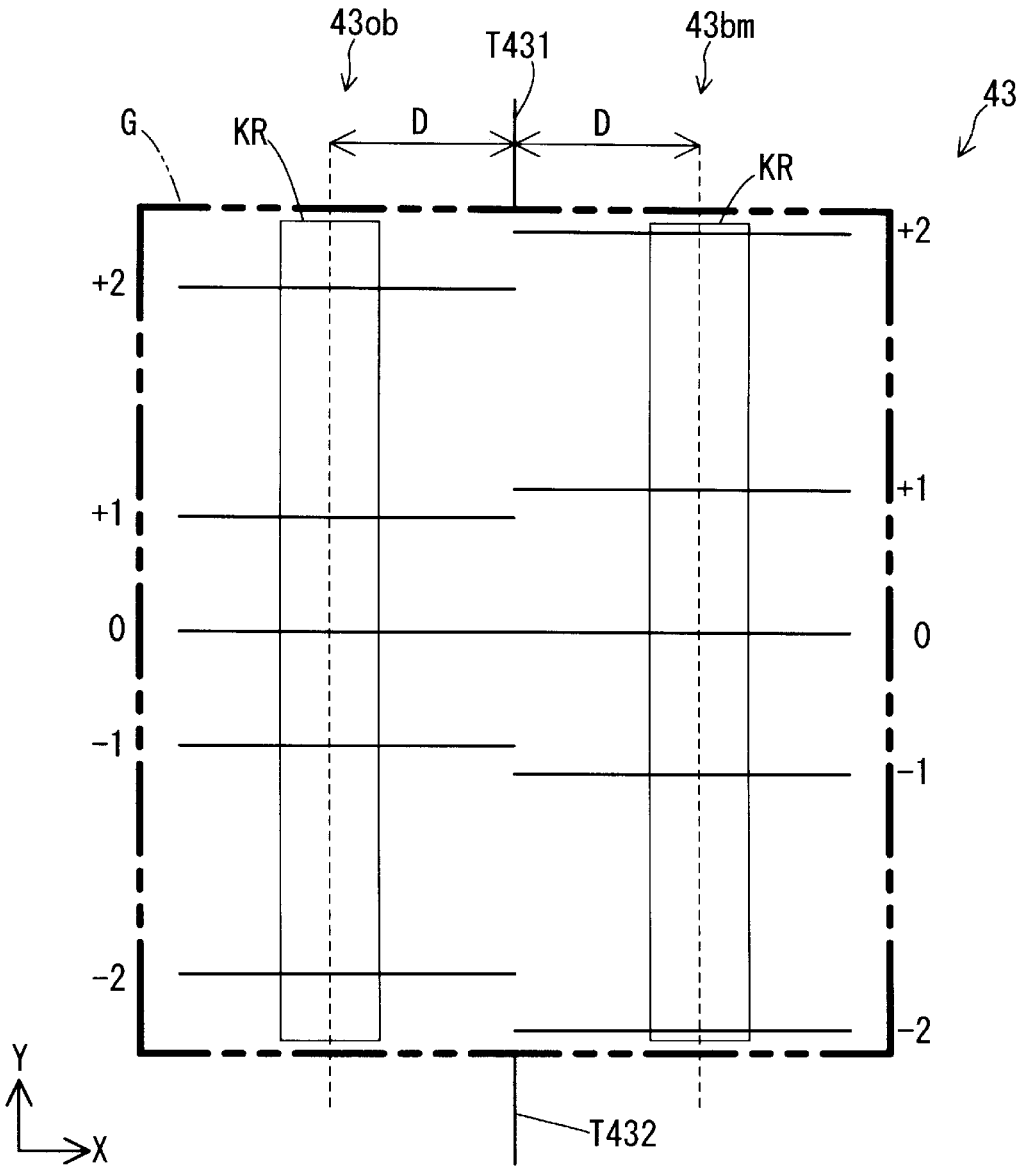
FIG. 19 is a diagram illustrating a third sector in a test pattern used to measure misalignment in a secondary scan direction.

FIG. 19 illustrates the third sector 43. The third sector 43 is configured to include a reference ruled line set 43*bm*, a measurement ruled line set 43*ob*, a crossmark T431, and a crossmark T432. Together, the reference ruled line set 43*bm* and the measurement ruled line set 43*ob* form a pair.

The values "−3" to "+3" illustrated in FIG. 18 represent misalignment amounts, and are not actually printed. The numbers "−2" to "+2" illustrated in FIG. 19 represent misalignment amounts, and are not actually printed. In both FIG. 18 and FIG. 19, the Y direction positions of the ruled lines with the misalignment amount "0" (referred to below as "specified ruled lines") are aligned with each other. Namely, both FIG. 18 and FIG. 19 illustrate a state in which no misalignment is present.

As illustrated in FIG. 18 and FIG. 19, in the present embodiment, the spacings between the ruled lines in the test pattern 40 are not uniform distances. Specifically, the distance between the ruled lines is determined in the following manner.

In the case of the reference ruled line set 42*bm* illustrated in FIG. 18, the distance from a ruled line with a misalignment amount n (n being an integer from −2 to +2) to the next ruled line is expressed by the following Equation (2). Note that out of the two ruled lines adjacent to the ruled line with the misalignment amount n, the "next ruled line" refers to the ruled line positioned on the side further away from the specified ruled line. Note that when n=0, the ruled line with the misalignment amount n is the specified ruled line, and as such, the next ruled line cannot be defined in the manner described above. However, in the present embodiment, when n=0, the distance is the same whether the next ruled line is the ruled line for the misalignment amount "−1" or the ruled line for the misalignment amount "+1", and so either the ruled line for the misalignment amount "−1" or the ruled line for the misalignment amount "+1" may be considered to be the next ruled line.

$$Dbm(n)=|n|\times a \tag{2}$$

In the above Equation (2), a is a constant greater than zero. From the above Equation (2), it can be seen that the distance between the ruled lines of the reference ruled line set 42*bm* increases the further from the specified ruled line. The method for determining the distance between the ruled lines using Equation (2) is common to each of the head sectors.

In the reference ruled line set 42*bm*, the position of a ruled line with a misalignment amount n' (n' being an integer from −3 to +3) as referenced against the specified ruled line is expressed by the following Equation (3).

$$Ebm(n')=n'a(|n'|+1)/2 \tag{3}$$

On the other hand, in the case of the measurement ruled line set 42*ob*, the position of a ruled line with a misalignment amount n' (n' being an integer from −3 to +3) as referenced against the specified ruled line is expressed by the following Equation (4).

$$Eob(n')=n'[\{a(|n'|+1)/2\}-b] \tag{4}$$

In Equation (4), b is a constant satisfying 0<b<a/2. According to Equation (4) and with b<a/2, the distance between the ruled lines of the measurement ruled line set 42*ob* increases the further from the specified ruled line. The method for determining the distance between the ruled lines using Equation (4) is common to each of the head sectors.

In the case of the reference ruled line set 43*bm* illustrated in FIG. 19, the distance Dbm (n) from the ruled line with the misalignment amount n to the next ruled line, and the position of the ruled line with the misalignment amount n' as referenced against the specified ruled line, can be expressed by Equations (2) to (4), similarly to for the head sectors. Accordingly, the distance between the ruled lines of the measurement ruled line set 43*ob* increases the further from the specified ruled line, and the distance between the ruled lines of the reference ruled line set 43*bm* also increases the further from the specified ruled line. Note that n is substituted for an integer from −1 to +1, and n' is substituted for an integer from −2 to +2. The values of the constants a and b may be the same as those used for the head sectors, or may be changed.

The misalignment in landing positions between the print heads is Y direction misalignment when referenced against a landing position of a reference head. Accordingly, all of the reference ruled line sets of the head sectors are formed using cyan ink.

The measurement ruled line sets of the head sectors are formed by ink ejected from the optimizer print head 30*op* that is to be measured.

In the tip sectors, each region is employed in order to measure landing position misalignment between the print tips in the overlapping regions. Accordingly, in the tip sectors, the respective pairs of reference ruled line sets and measurement ruled line sets are formed by ejecting ink from the optimizer print head 30*op*.

In each tip sector, the reference ruled line set is formed using a print tip at a downstream side position in the transport direction of the print medium MD. Moreover, in each tip sector, the measurement ruled line set is formed using a print tip at an upstream side position in the transport direction of the print medium MD. For example, the reference ruled line set 43*bm* is formed by the first print tip 31*op*, and the measurement ruled line set 43*ob* is formed by the second print tip 32*op*.

When S240 is performed using the test pattern 40, tip misalignment and head misalignment are both identified. When S240 is performed using the test pattern 50, tip misalignment, forward/reverse misalignment of both the nozzle rows A, B, row misalignment, head misalignment, yaw misalignment, and roll misalignment as described above are all identified.

Next, a determination is made as to whether or not all detection has been completed (S250). In cases in which sectors for which detection has not been completed still remain (S250=NO), S210 to S240 are repeated as appropriate. In cases in which all detection has been completed (S250=YES), the impact displacement amount measurement processing is ended.

When the impact displacement amount measurement processing has been ended, impact displacement correction calculation is executed (S290), and then the correction processing is ended. When the correction processing has been ended, dot formation processing is executed (S300).

Figure 20:
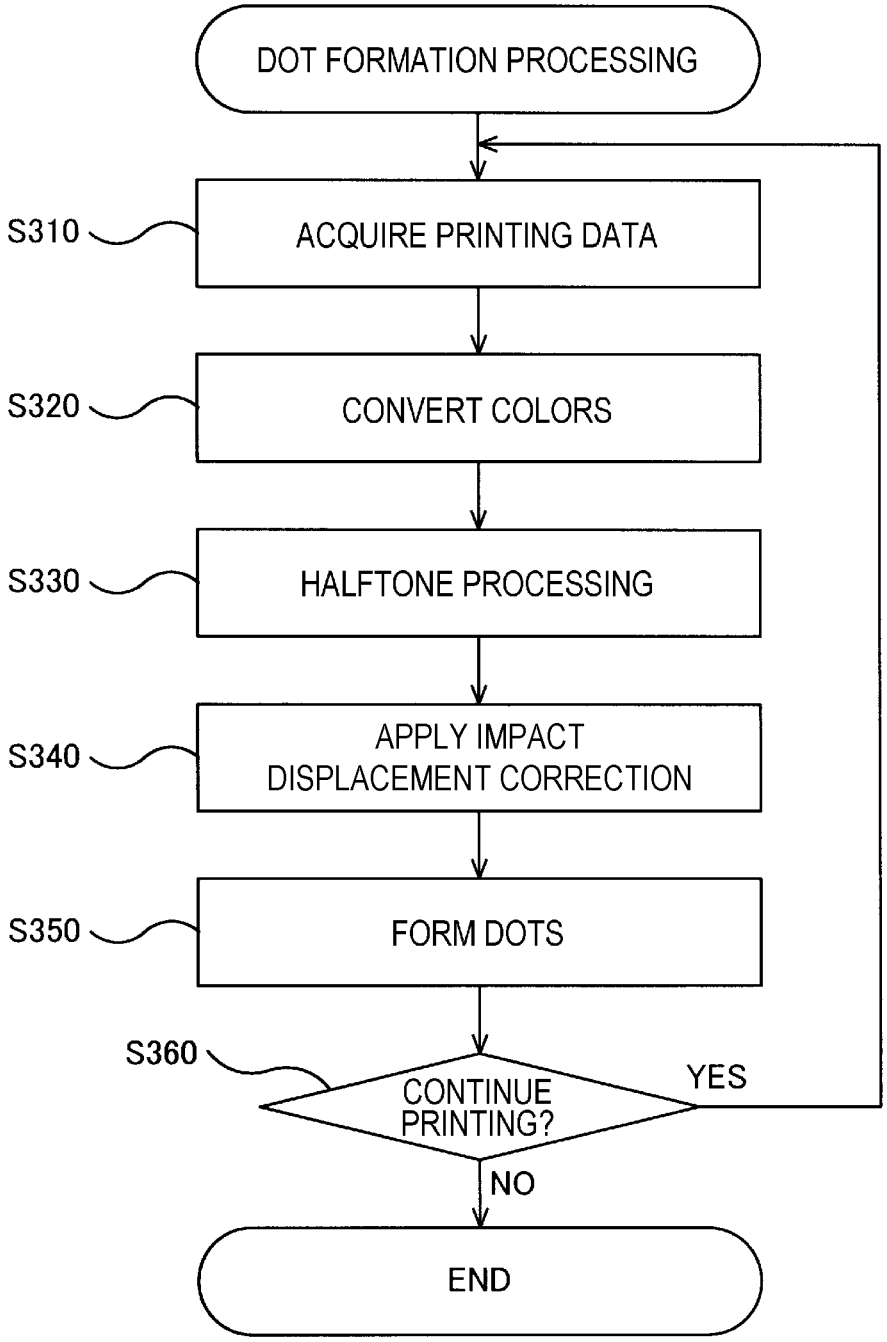
FIG. 20 is a flowchart illustrating dot formation processing.

FIG. 20 is a flowchart illustrating dot formation processing. First, printing data to be printed is acquired (S310). Next, color conversion is executed (S320). Namely, printing data expressed in RGB is converted to ink values using the CMYKLcLm color system. Next, halftone processing is executed (S330).

The impact displacement correction is then applied (S340). Namely, dot data obtained by the halftone processing is corrected using the impact displacement correction saved at S290.

Next, dots are formed using the corrected dot data (S350). At S350, dots are formed as appropriate using the optimizer ink. When dot formation based on the printing data acquired at S310 has been completed, a determination is made as to whether or not to continue printing (S360). In cases in which printing is to be continued (S360=YES), processing returns to S310. In cases in which printing is to be ended (S360=NO), the dot formation processing is ended. Accompanying this, printing processing is also ended.

Figure 21:
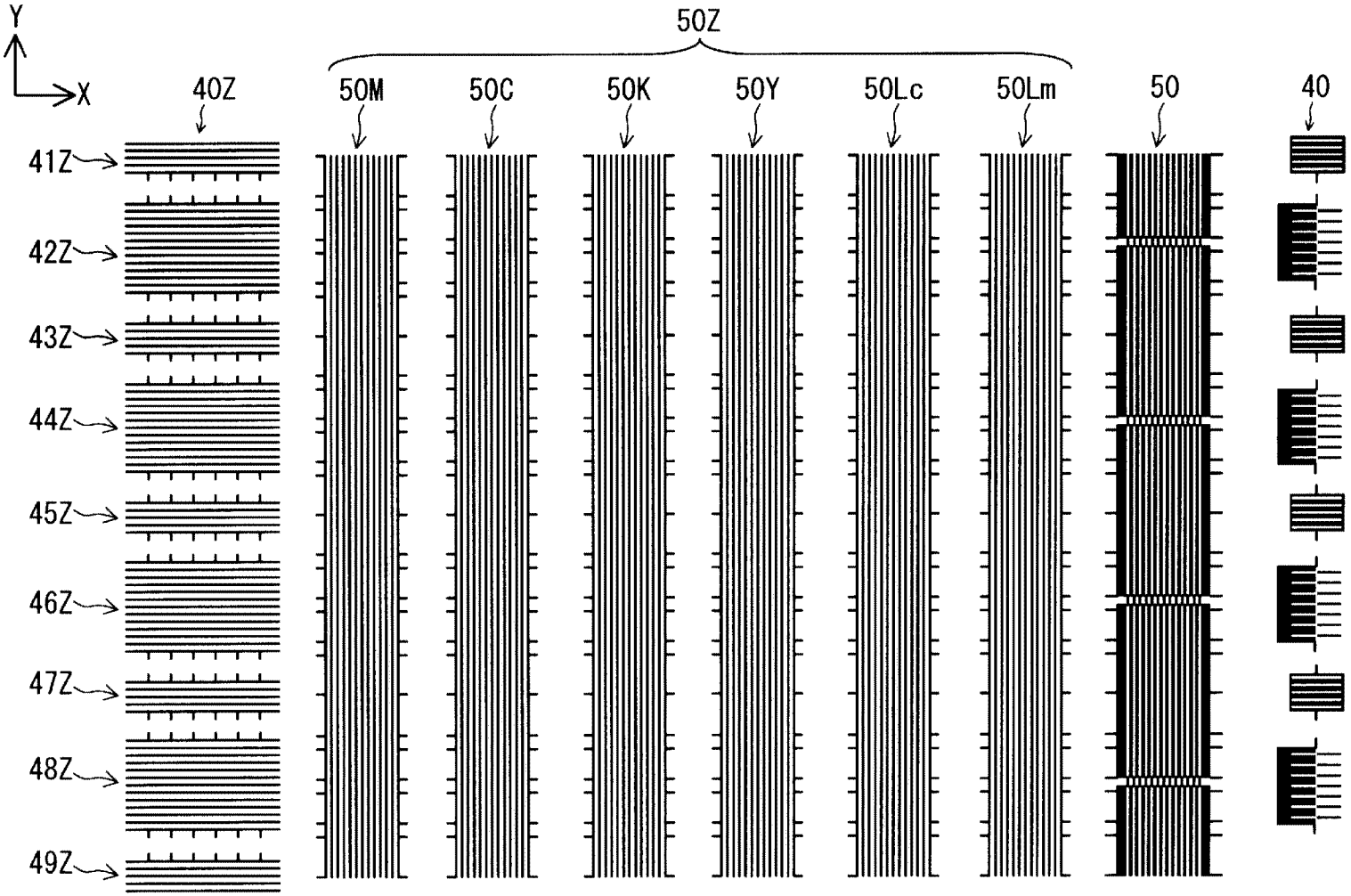
FIG. 21 is a diagram illustrating test patterns of a second embodiment.

Explanation follows regarding a second embodiment. FIG. 21 illustrates a test pattern of the second embodiment. The test pattern of the second embodiment includes test patterns 40Z, 50Z in addition to the test patterns 40, 50 described in the first embodiment.

Features of the test patterns 40Z, 50Z that are not explicitly described are, in principle, the same as those of the test pattern 40 in the case of the test pattern 40Z, and the same as those of the test pattern 50 in the case of the test pattern 50Z. Explanation follows regarding the test patterns 40Z, 50Z.

The test pattern 40Z is used to measure impact displacement in the secondary scan direction of the colored inks. The test pattern 50Z is used to measure impact displacement in the primary scan direction of the colored inks. The test patterns 40Z, 50Z are subjected to the correction processing. Namely, the test patterns 40Z, 50Z are formed by S110 and S115, and similarly to the test patterns 40, 50, are subjected to impact displacement amount measurement (S200) and the like.

The test pattern 40 is positioned furthest to the positive side in the X direction. The test pattern 50 is positioned on the negative side of the test pattern 40 in the X direction. The test pattern 50Z is positioned on the negative side of the test pattern 50 in the X direction. The test pattern 40Z is positioned on the negative side of the test pattern 50Z.

Similarly to the test pattern 40, the test pattern 40Z includes a first sector 41Z to an eighth sector 48Z. The test pattern 40Z differs from the test pattern 40 in that it also includes a ninth sector 49Z. Note that the ninth sector 49Z is not employed in impact displacement measurement.

The test pattern 50Z includes test patterns 50M, 50C, 50K, 50Y, 50Lc, and 50Lm. The test patterns 50M, 50C, 50K, 50Y, 50Lc, and 50Lm are used to measure primary scan direction impact displacement for magenta ink in the case of the test pattern 50M, cyan ink in the case of the test pattern 50C, black ink in the case of the test pattern 50K, yellow ink in the case of the test pattern 50Y, light cyan ink in the case of the test pattern 50Lc, and light magenta ink in the case of the test pattern 50Lm.

The test patterns 40Z, 50Z differ from the test patterns 40, 50 in the point that they do not include the base-coat G. Accordingly, the determination will always be YES when S235 of the ruled line detection processing is performed on the test patterns 40Z, 50Z.

The test patterns 50M, 50C, 50K, 50Y, 50Lc, and 50Lm each have similar features with the exception of the point that the ink color measured for impact displacement differs. Explanation follows regarding the test pattern 50M as a representative.

Figure 22:
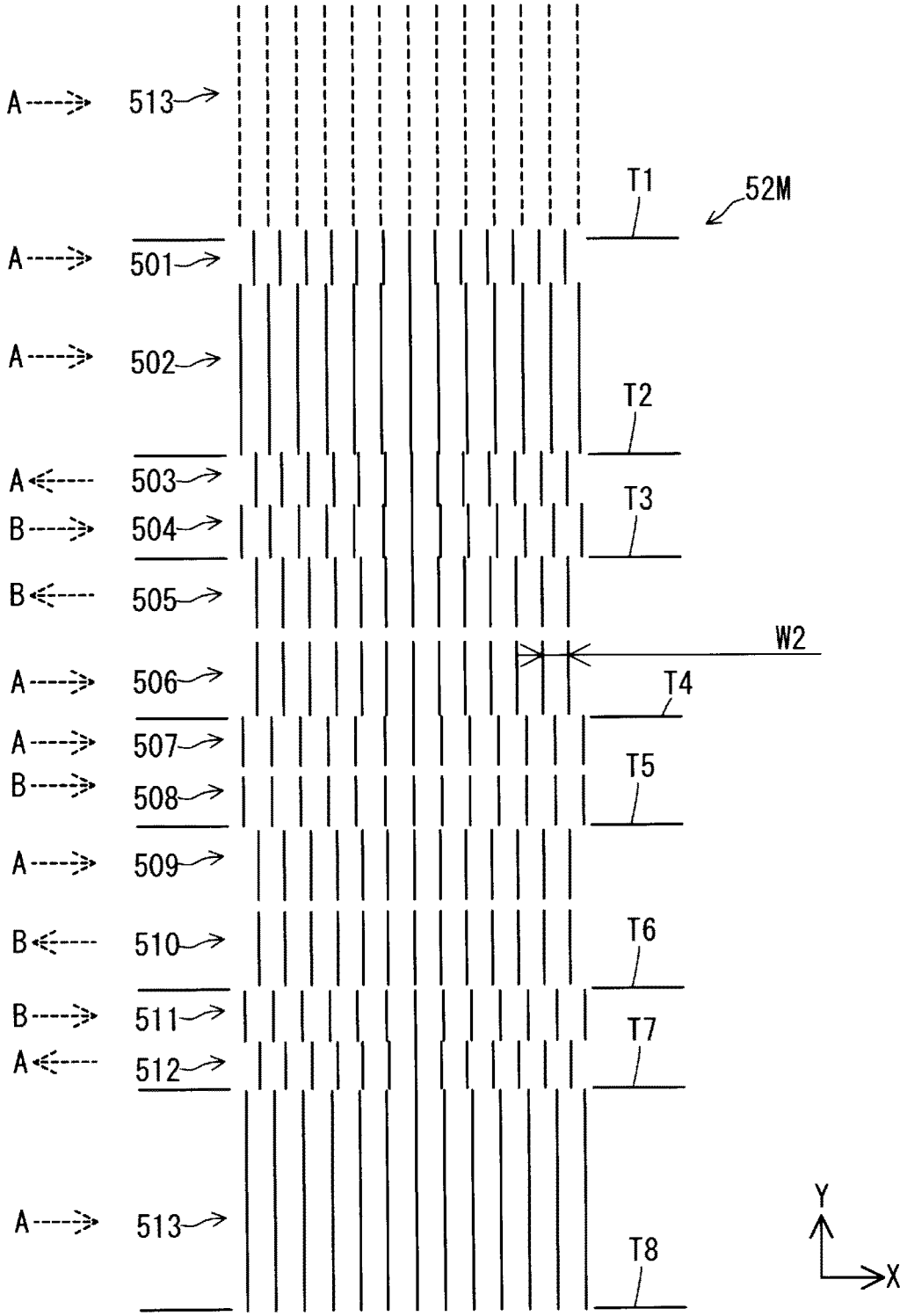
FIG. 22 is a diagram illustrating a second sector used for magenta in a primary scan direction.

FIG. 22 illustrates a second sector 52M. The second sector 52M is a sector of the test pattern 50M corresponding to the second sector 42 of the test pattern 50.

A spacing between the ruled lines of a sixth ruled line set 506 in the second sector 52M is a spacing W2. The spacing W1 of the test pattern 50 is wider than the spacing W2. The spacing W1 is set wider than the spacing W2 since the sixth ruled line set 506 is liable to bleed into the base-coat G in the test pattern 50.

Note that since the spacing W1 is wider than the spacing W2, the number of ruled lines included in the sixth ruled line set 506 in the test pattern 50 is two fewer than the number of ruled lines included in the sixth ruled line set 506 in the test pattern 50M.

Having a wider spacing between the ruled lines than in the test pattern 50M is a feature that is also common to each ruled line set in the test pattern 40.

Figure 23:
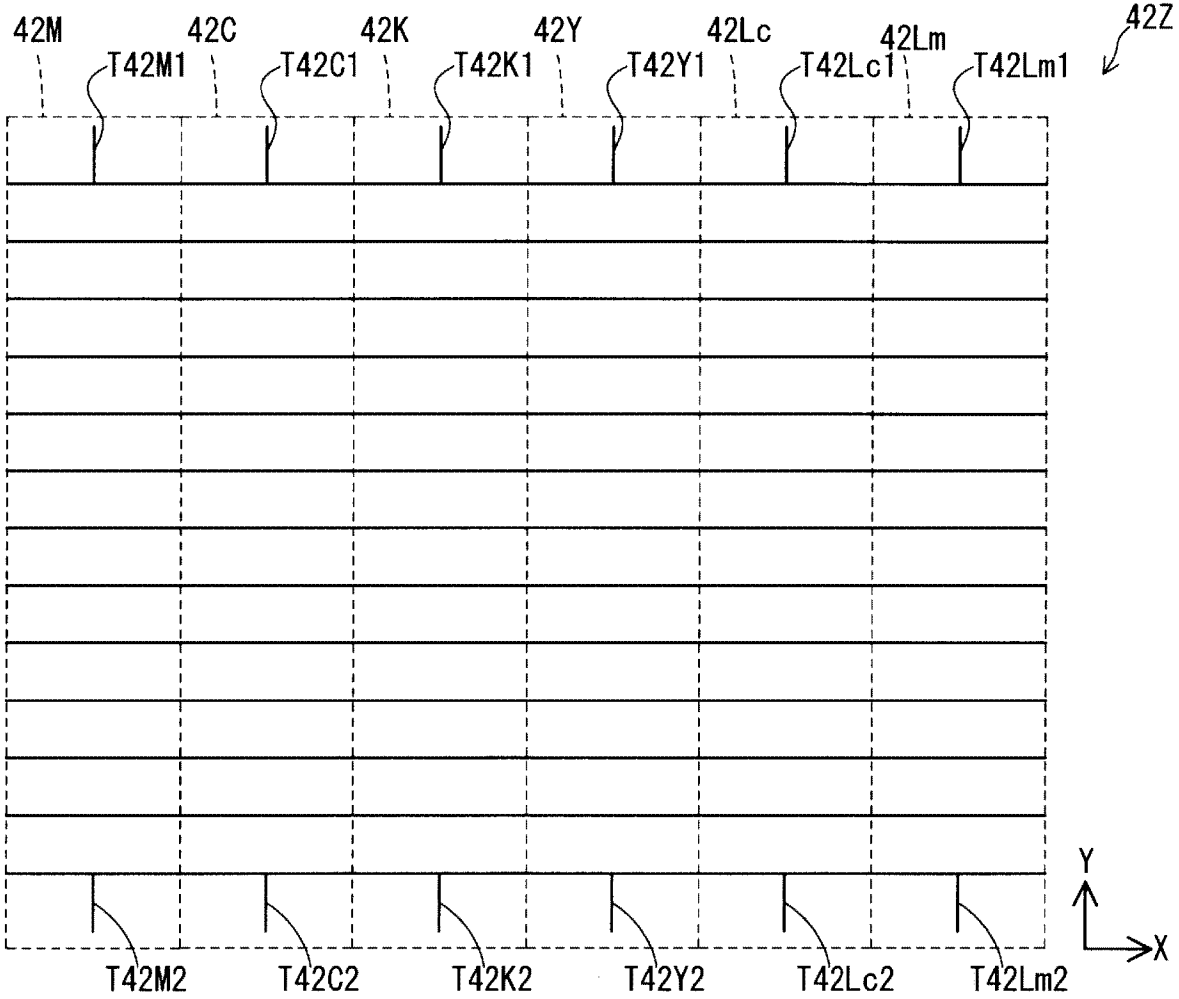
FIG. 23 is a diagram illustrating a second sector used for colored ink in a secondary scan direction.

FIG. 23 illustrates a second sector 42Z. The second sector 42Z is a sector used to measure impact displacement of the first print tip mounted to each print head. Note that the fourth sector 44Z is a sector used to measure impact displacement of the second print tip mounted to each print head. The sixth sector 46Z is a sector used to measure impact displacement of the third print tip mounted to each print head. The eighth sector 48Z is a sector used to measure impact displacement of the fourth print tip mounted to each print head.

The respective locations belonging to the respective head sectors have the same features as each other with the exception of being used for different print tips. Accordingly, the second sector 42Z will be described below as a representative of the head sectors.

The second sector 42Z is configured from a magenta region 42M, a cyan region 42C, a black region 42K, a yellow region 42Y, a light cyan region 42Lc, and a light magenta region 42Lm. The rectangles illustrated by dashed lines indicate hypothetical boundary lines, and are not actually printed.

Figure 24:
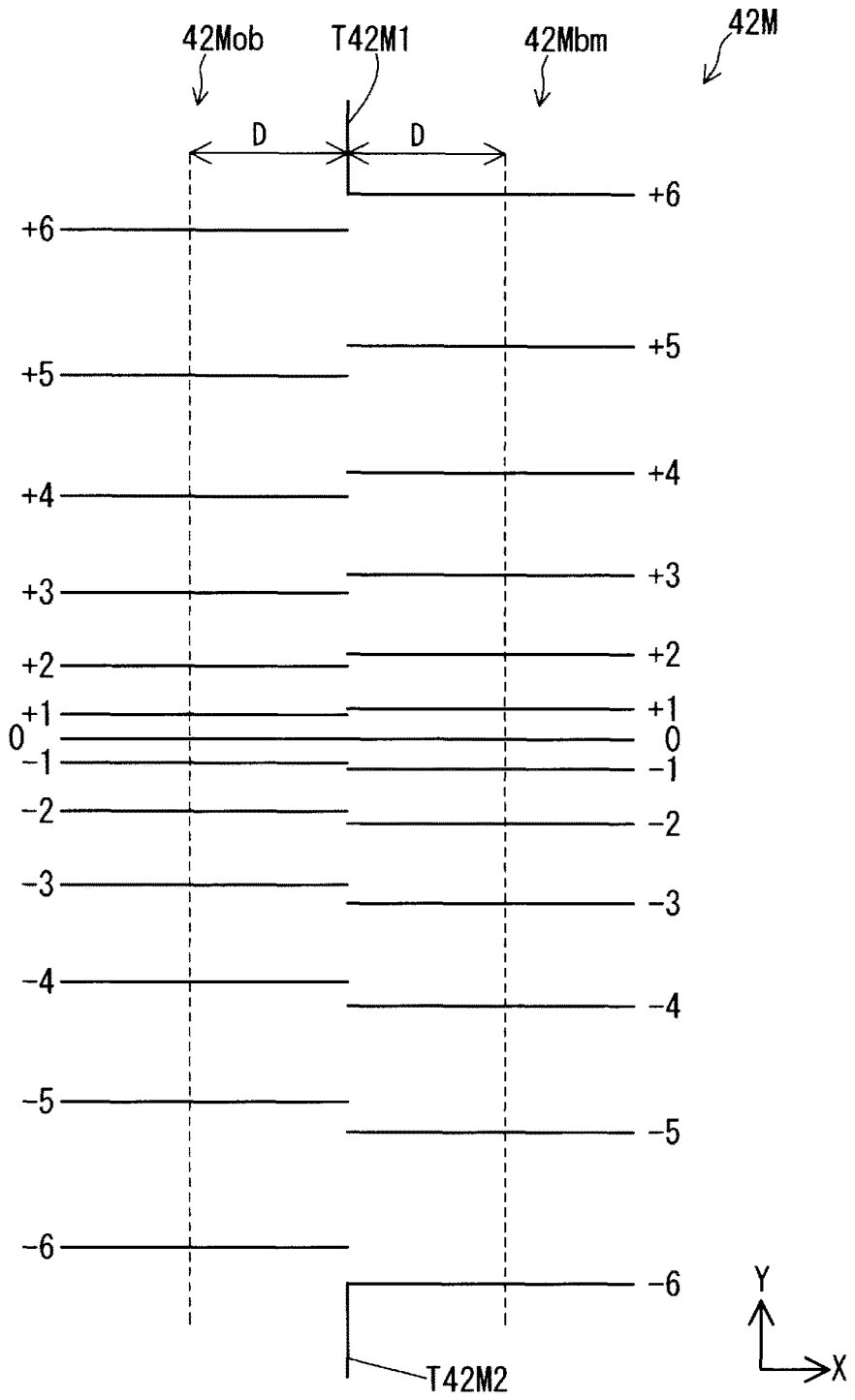
FIG. 24 is a diagram illustrating a second sector used for magenta in a secondary scan direction.

FIG. 24 illustrates the magenta region 42M in isolation. The magenta region 42M is configured from a reference ruled line set 42Mbm, a measurement ruled line set 42Mob, a crossmark T42M1, and a crossmark T42M2. Together, the reference ruled line set 42Mbm and the measurement ruled line set 42Mob form a pair.

The magenta region 42M is provided with misalignment amounts from −6 to +6, as illustrated in FIG. 24.

In the magenta region 42M, the distance from a ruled line with a misalignment amount n (n being an integer from −5 to +5) to the next ruled line is expressed by the following Equation (5).

$$Dbm(n)=|n|\times a\times c \tag{5}$$

In the above Equation (5), c is a constant greater than zero and less than one. Accordingly, for the same value n, the distance computed using Equation (5) is shorter than the distance computed using Equation (2).

In the reference ruled line set 42Mbm, similarly to in the reference ruled line set 42*bm* for the optimizer ink, the spacings are set so as to enable impact displacement to be measured corresponding to the position of the magenta region 42M. Accordingly, for the same value n, the spacings between the ruled lines in the reference ruled line set 42*bm* for the optimizer ink are wider than the spacings between the ruled lines in the magenta region 42M. Setting in this manner is a countermeasure against bleed in the measurement ruled line set 42*ob*, similarly to in the case of the test pattern 50.

The present disclosure is not limited to the embodiments, examples, and modified examples of the present specification, and various configurations may be implemented within a range that does not depart from the spirit of the present disclosure. For example, appropriate substitutions or combinations may be made to the technical features in the embodiments, examples, and modified examples corresponding to the technical features described in the aspects in the "Summary" section, in order to address some or all of the issues described above, or in order to achieve some or all of the advantageous effects described above. Technical features not indicated to be essential in the present specification may be omitted as appropriate. See, for example, the following examples.

The printing apparatus need not be equipped with functionality to image the test patterns or to execute the impact displacement amount measurement processing. In such cases, a detection section configuring the printing system may image the test patterns and execute the impact displacement amount measurement processing in coordination with the printing apparatus.

In sectors used to measure Y direction impact displacement, the spacings between the ruled lines need not increase the further away from the specified ruled line.

The reference head may be any print head that is neither the print head that ejects ink for the base-coat nor the optimizer print head.

The direction of the forward pass and the reverse pass in the primary scan direction may be reversed from the examples described in the embodiments.

In the embodiments described above, some or all of the functions and processing implemented using software may be implemented by hardware. Moreover, some or all of the functions and processing implemented using hardware may be implemented by software. Various circuits may be employed as hardware, for example: integrated circuits, discrete circuits, or circuit modules that include a combination of such circuits.

What is claimed is:

1. A method of creating a test pattern, the method comprising:

providing a printing apparatus comprising:

a transparent ink print head configured to eject a transparent ink, a first print head configured to eject a first colored ink, and a second print head configured to eject a second colored ink;

forming a base-coat on a print medium using the first colored ink; and creating a plurality of ruled lines to measure impact displacement of the transparent ink so as to form a first ruled line set formed by layering the transparent ink over the base-coat, and a second ruled line set formed outside a region corresponding to the base-coat using the second colored ink.

2. The creation method according to claim 1, wherein the first ruled line set and the second ruled line set are employed to measure impact displacement arising as a result of head misalignment of the transparent ink print head with respect to the second print head in a primary scan direction.

3. The creation method according to claim 2, wherein:

the transparent ink print head comprises a first print tip and a second print tip;

the first print tip comprises a plurality of nozzles forming a first nozzle row arranged along a secondary scan direction, and a second nozzle row positioned on a predetermined side of the first nozzle row in the primary scan direction; and as locations to measure impact displacement in the primary scan direction, the test pattern includes at least one of:

a location to measure impact displacement arising as a result of tip misalignment of the first print tip and the second print tip, a location to measure impact displacement arising as a result of forward/reverse misalignment of an forward pass and a reverse pass of a primary scan, a location to measure impact displacement arising as a result of row misalignment of the first nozzle row and the second nozzle row, a location to measure impact displacement arising as a result of positional misalignment of the transparent ink print head in a rotation direction about the primary scan direction, and/or a location to measure impact displacement arising as a result of positional misalignment of the transparent ink print head in a rotation direction about a direction orthogonal to both the primary scan direction and the secondary scan direction.

4. The creation method according to claim 1, wherein the first ruled line set and the second ruled line set are employed to measure impact displacement arising as a result of head misalignment of the transparent ink print head with respect to the second print head in a secondary scan direction.

5. The creation method according to claim 4, wherein:

the transparent ink print head comprises a first print tip and a second print tip; and the test pattern includes a location to measure impact displacement arising as a result of tip misalignment of the first print tip and the second print tip in a secondary scan direction.

6. The creation method according to claim 1, further comprising:

creating a plurality of ruled lines to measure impact displacement of the first colored ink, so as to form a third ruled line set formed using the first colored ink, and a fourth ruled line set formed using the second colored ink, wherein both the third ruled line set and the fourth ruled line set are formed outside the region corresponding to the base-coat.

7. The creation method according to claim 6, wherein a spacing between ruled lines in the first ruled line set is wider than a spacing between ruled lines in the third ruled line set.

8. The creation method according to claim 6, wherein secondary scan direction positions of the first ruled line set and the second ruled line set at least partially overlap with secondary scan direction positions of the third ruled line set and the fourth ruled line set.

9. The creation method according to claim 1, wherein the printing apparatus comprises a third print head configured to eject a third colored ink; and the second ruled line set is formed after deciding to employ the second colored ink to form the second ruled line set based on a comparison of usage frequencies of the second colored ink and the third colored ink in printing by the printing apparatus.

10. A test pattern comprising:

a plurality of ruled lines to measure impact displacement of a transparent ink so as to form:

a first ruled line set formed by layering the transparent ink over a base-coat formed on a print medium using a first colored ink; and a second ruled line set formed outside a region corresponding to the base-coat using a second colored ink.

11. A printing system comprising:

a printing apparatus comprising:

a transparent ink print head configured to eject a transparent ink, a first print head configured to eject a first colored ink, and a second print head configured to eject a second colored ink, wherein the transparent ink print head comprises a first print tip and a second print tip, and wherein the first print tip comprises a plurality of nozzles forming a first nozzle row arranged along a secondary scan direction, and a second nozzle row positioned on a predetermined side of the first nozzle row in a primary scan direction;

wherein the printing system is configured to:

form a base-coat on a print medium using the first colored ink; and create a plurality of ruled lines to measure impact displacement of the transparent ink so as to form a first ruled line set formed by layering the transparent ink over the base-coat, and a second ruled line set formed outside a region corresponding to the base-coat using the second colored ink.

12. The printing system according to claim 11, further comprising:

a detection section configured to detect a position of each ruled line in the first ruled line set;

wherein the printing system is configured such that, in cases in which a brightness of the base-coat is lower than a brightness of each ruled line in the first ruled line set, the detection section executes processing to invert a relative relationship between the brightness of the base-coat and the brightness of each ruled line in the first ruled line in order to detect the position of each ruled line in the first ruled line set.

13. A non-transient computer readable medium for a printing apparatus that comprises a transparent ink print head configured to eject a transparent ink, a first print head configured to eject a first colored ink, and a second print head configured to eject a second colored ink, the transparent ink print head being comprising a first print tip and a second print tip, and the first print tip comprising a plurality of nozzles configuring a first nozzle row arranged along a secondary scan direction, and a second nozzle row positioned on a predetermined side of the first nozzle row in a primary scan direction, the non-transient computer readable medium comprising instructions that, when executed by a processor, cause the printing apparatus to:

form a base-coat on a print medium using the first colored ink; and create a plurality of ruled lines to measure impact displacement of the transparent ink so as to form a first ruled line set formed by layering the transparent ink over the base-coat, and a second ruled line set formed outside a region corresponding to the base-coat using the second colored ink.

* * * * *